US008181744B2

(12) United States Patent
Parker et al.

(10) Patent No.: US 8,181,744 B2
(45) Date of Patent: May 22, 2012

(54) SELF-RETRACTING LIFELINE SYSTEMS AND BRAKING SYSTEMS THEREFOR

(75) Inventors: Thomas W. Parker, Jamestown, PA (US); Ross Balquist, Slippery Rock, PA (US)

(73) Assignee: Honeywell International Inc., Morristown, NJ (US)

( * ) Notice: Subject to any disclaimer, the term of this patent is extended or adjusted under 35 U.S.C. 154(b) by 462 days.

(21) Appl. No.: 12/392,061

(22) Filed: Feb. 24, 2009

(65) Prior Publication Data

US 2009/0211848 A1 Aug. 27, 2009

Related U.S. Application Data

(60) Provisional application No. 61/031,336, filed on Feb. 25, 2008, provisional application No. 61/045,808, filed on Apr. 17, 2008.

(51) Int. Cl.
*A62B 1/08* (2006.01)

(52) U.S. Cl. ..... 182/232; 182/234; 182/236; 242/383.2; 242/383.5

(58) Field of Classification Search ..... 182/239, 182/236, 231, 232; 242/383.5, 383.2; 160/291, 160/300

See application file for complete search history.

(56) References Cited

U.S. PATENT DOCUMENTS

| | | | | |
|---|---|---|---|---|
| 3,369,768 | A * | 2/1968 | Burns | 242/382.1 |
| 3,421,605 | A * | 1/1969 | Hansen | 188/82.77 |
| 3,698,657 | A * | 10/1972 | Kirchhoff et al. | 242/383.2 |
| 3,754,722 | A * | 8/1973 | Nohren | 242/383.2 |
| 3,929,300 | A * | 12/1975 | Lindqvist | 242/383.5 |
| 4,228,970 | A * | 10/1980 | Morinaga | 242/383.5 |
| 4,619,418 | A * | 10/1986 | Butenop | 242/382.6 |
| 5,771,993 | A | 6/1998 | Anderson | |
| 7,883,045 | B2 * | 2/2011 | Yamada | 242/383.4 |
| 2009/0211847 | A1 * | 8/2009 | Balquist et al. | 182/231 |
| 2009/0211848 | A1 * | 8/2009 | Parker et al. | 182/231 |

FOREIGN PATENT DOCUMENTS

| | | | |
|---|---|---|---|
| WO | 9519204 | A1 | 7/1995 |
| WO | 9747359 | A1 | 12/1997 |
| WO | 2009108627 | A1 | 9/2009 |
| WO | 2009108646 | A8 | 9/2009 |

* cited by examiner

*Primary Examiner* — Blair M. Johnson

(74) *Attorney, Agent, or Firm* — Wood, Phillips, Katz, Clark & Mortimer

(57) ABSTRACT

A lifeline system includes a lifeline and a drum assembly around which the lifeline is coiled. The drum assembly is rotatable about a first axis in a first direction during extension of the lifeline and in a second direction, opposite of the first direction, during retraction of the lifeline. The lifeline system further includes a tensioning mechanism in operative connection with the drum assembly to impart a biasing force on the drum assembly to bias the drum assembly to rotate about the first axis in the second direction. The lifeline system further comprises a braking mechanism in operative connection with the drum assembly. The braking mechanism includes a catch that is rotatable relative to the drum assembly about a second axis that is not concentric with the first axis. The second axis is operatively connected to the first axis so that the second axis rotates about the first axis in the same direction as the drum assembly when the drum assembly is rotating about the first axis. A center of mass of the catch is located in the vicinity of the second axis. The catch rotates about the second axis in the second direction when the drum assembly is rotated in the first direction at at least a determined angular acceleration to cause an abutment section of the catch to abut an abutment member of the lifeline system (for example, by moving radially outward a sufficient amount) and stop the rotation of the drum assembly.

20 Claims, 16 Drawing Sheets

SECTION A-A 20a
92a
94a
180a
80a
192a
190a
195a
193a
100a
150a
113a
194a
116a
114a
112a
110a
100a
117a
120a
123a
40a
140a
30a
50a
142a
52a
54a
60a
160a
56a
62a
163a'
163a
44a
168a
164a
162a
168a
73a
80a
70a
71a
76a
20a

SECTION A-A
SCALE 1:1

SELF-RETRACTING LIFELINE SYSTEMS AND BRAKING SYSTEMS THEREFOR

CROSS-REFERENCE TO RELATED APPLICATION

This application claims benefit of U.S. Provisional Patent Application Ser. No. 61/031,336, filed Feb. 25, 2008, and U.S. Provisional Patent Application Ser. No. 61/045,808, filed Apr. 17, 2008, the disclosures of which are incorporated herein by reference.

BACKGROUND OF THE INVENTION

The present invention relates to lifeline systems and, particularly, to self-retracting lifeline systems and braking systems therefore.

The following information is provided to assist the reader to understand the invention disclosed below and the environment in which it will typically be used. The terms used herein are not intended to be limited to any particular narrow interpretation unless clearly stated otherwise in this document. References set forth herein may facilitate understanding of the present invention or the background of the present invention. The disclosures of all references cited herein are incorporated by reference.

Many devices have been developed in an attempt to prevent or minimize injury to a worker falling from a substantial height. For example, a number of devices (known alternatively as self-retracting lifelines, self-retracting lanyards, fall arrest blocks, etc.) have been developed that limit a worker's free fall distance to a specified distance and limit fall arresting forces to a specified value.

In general, most currently available self retracting lifeline safety devices or systems include a number of common components. Typically, a housing or cover provides enclosure/protection for the internally housed components. The housing includes attached thereto a connector for anchoring the self-retracting lifeline to either the user or to a fixed anchor point. The connector must be capable of withstanding forces required to stop a falling body of a given mass in a given distance.

A drum or spool around which a lifeline is coiled or spooled rotates within the housing. The drum is typically under adequate rotational tension to reel up excess extended lifeline without hindering the mobility of the user. Like the anchor connector and the other operative components of the retractable lifeline safety device, the drum is formed to withstand forces necessary to stop a falling body of a given mass in a given distance. The lanyard or lifeline is attached at one end thereof to the drum to allow the drum to reel in excess lifeline. The lifeline is attached at the other end thereof to either the user or to an anchorage point, whichever is not already attached to the housing.

Self-retracting lifeline systems also include a braking mechanism which locks (that is, prevents rotation of) the drum assembly of the self-retracting lifeline upon indication that a fall is occurring. For example, when the safety line (for example, rope, cable or web) being pulled from the self-retracting lifeline system causes the drum assembly to rotate above a certain angular velocity, a brake mechanism can cause the drum assembly to suddenly lock.

Many currently available braking systems for self-retracing lanyard systems actuate upon the drum assembly reaching a predetermined angular velocity. The rotational velocity of the drum assembly is proportional to the linear velocity of the safety line. In the case of a self-retracting lanyard braking system which actuates at a predetermined or threshold angular velocity (such as that disclosed in U.S. Pat. No. 5,771,993), a pawl is typically attached to the drum assembly at a pawl pivot that is spaced from the center of gravity of pawl. The pawl can pivot relative to the drum assembly about the pawl pivot. A pawl spring applies a force tending to keep the pawl retracted against a pawl stop on the drum assembly. When the pawl is retracted, it cannot strike an abutment as the drum assembly rotates. As the drum assembly rotates, the center of mass of the pawl tends to follow a straight path tangent to the drum assembly, but the pawl is prevented from pivoting outward by the force of the pawl spring. If, however, the drum rotates at a sufficient velocity, the centripetal force required to keep the pawl against the pawl stop will exceed the force supplied by the pawl spring. At that point, the pawl rotates about the pawl pivot to a radially outwardly extended position wherein the pawl abuts an abutment (for example, on the housing) and brings the drum assembly (and the safety line) to a halt.

In designing a velocity actuated brake, the desired maximum or threshold safety line velocity (and a corresponding angular velocity of the drum assembly) must be defined. For example, the velocity or speed of a fast walk can be used. From the maximum safety line velocity, the maximum or threshold angular or rotational velocity of the drum assembly is determined. The centripetal force that must be supplied by the pawl spring is then determined from the mass of the pawl.

Braking systems based upon angular acceleration are, for example, commonly used in connection with automobile seatbelt restraints. Currently available acceleration braking systems typically include a system of low strength, complexly interacting parts and have not been widely accepted in the fall protection arts.

Although a number of braking mechanisms have been developed for use in connection with self-retracting lifeline and other systems, such mechanisms are often complex (for example, requiring a significant number of interconnected and often complexly operating components), relatively high in cost and insufficiently rugged.

It is thus desirable to develop systems, devices and methods that reduce or eliminate the above and other problems associated with currently available self-retracting lifeline systems.

SUMMARY OF THE INVENTION

In one aspect, the present invention provides a lifeline system including a lifeline and a drum assembly around which the lifeline is coiled. The drum assembly is rotatable about a first axis in a first direction during extension of the lifeline and in a second direction, opposite of the first direction, during retraction of the lifeline. The lifeline system further includes a tensioning mechanism in operative connection with the drum assembly to impart a biasing force on the drum assembly to bias the drum assembly to rotate about the first axis in the second direction. The lifeline system further comprises a braking mechanism in operative connection with the drum assembly. The braking mechanism includes a catch that is rotatable relative to the drum assembly about a second axis that is not concentric with the first axis. The second axis is operatively connected to the first axis so that the second axis rotates about the first axis in the same direction as the drum assembly when the drum assembly is rotating about the first axis. A center of mass of the catch is located in the vicinity of the second axis. The catch rotates about the second axis in the second direction when the drum assembly is rotated in the first direction at at least a determined angular acceleration to cause an abutment section of the catch to abut an abutment member of the lifeline system (for example, by moving radially outward a sufficient amount) and stop the rotation of the drum assembly.

The system can further include a biasing mechanism to bias the catch to rotate in the first direction about the second axis (or equivalently, to bias the catch against rotating in the second direction). In several embodiments, the biasing force of the biasing mechanism is balanced against rotational inertia of the catch so that catch rotates in the second direction only when the lifeline is extended at an accelerating rate corresponding to the determined angular acceleration of the drum assembly. The biasing mechanism can, for example, include a spring mechanism attached at one end to the drum assembly and attached at another end to the catch. The spring mechanism can for example, include a torsion spring, an extension spring, a compression spring or a spring clip.

The first axis can, for example, be defined by or correspond to the axis of a shaft passing generally through the center of the drum assembly. In several embodiments, the shaft passes through a slot formed in the catch.

The catch can, for example, be rotatable about the second axis relative to the drum assembly about an extending member extending from the drum assembly. The extending member can define the second axis.

The drum assembly can further include at least one abutment element to limit rotation of the catch in the first direction and to limit rotation of the catch in the second direction. In several embodiments in which the catch includes a slot therein, the slot of the catch is arced or curved and contact or abutment of edges of the slot with the shaft limits rotation of the catch in the first direction and limits rotation of the catch in the second direction The center of mass of the catch can, for example, be located in the vicinity of or generally upon the second axis.

In another aspect, the present invention provides a braking mechanism for use in a lifeline system. The lifeline system includes a lifeline and a drum assembly around which the lifeline is coiled. The drum assembly is rotatable about a shaft defining a first axis in a first direction during extension of the lifeline and in a second direction, opposite of the first direction, during retraction of the lifeline. The lifeline system further includes an abutment member. The braking mechanism includes a catch including a slot through which the shaft can pass, an element defining a second axis about which the catch is rotatable relative to the drum that is not concentric with the first axis, and at least one abutment section to abut an abutment member of the lifeline system and stop the rotation of the drum assembly. The second axis is operatively connected to the shaft so that the second axis rotates about the first axis in the same direction as the drum assembly when the drum assembly is rotating about the first axis. A center of mass of the catch is located in the vicinity of the second axis. The center of mass of the catch can, for example, be located generally (or exactly) upon the second axis. The abutment section of the catch abuts the abutment member of the lifeline upon rotation of the catch about the second axis in the second direction. The catch rotates about the second axis in the second direction when the drum assembly is rotated in the first direction at at least a determined angular acceleration In a further aspect, the present invention provides a lifeline system including a lifeline; a shaft having a first axis, a hub connected to the shaft to rotate with the shaft and an abutment member. The lifeline is coiled around the hub. The hub is rotatable with the shaft in a first direction during extension of the lifeline and in a second direction, opposite of the first direction, during retraction of the lifeline. The lifeline system further includes a tensioning mechanism in operative connection with shaft to impart a biasing force on the shaft to bias the shaft to rotate about the first axis in the second direction. The lifeline system also includes a braking mechanism in operative connection with the shaft. The braking mechanism includes a catch that is rotatable about a second axis that is not concentric with the first axis defined by the shaft. The second axis is operatively connected to the shaft so that the second axis rotates about the first axis in the same direction as the drum assembly when the drum assembly is rotating about the first axis. A center of mass of the catch is located in the vicinity of the second axis. The catch rotates about the second axis in the second direction when the shaft is rotated in the first direction at at least a determined angular acceleration to cause an abutment section of the catch to move radially outward (relative to the shaft/first axis) a sufficient amount to abut the abutment member of the lifeline system and stop the rotation of the shaft. A center of mass of the catch is preferably located in the vicinity of or generally upon the second axis.

In another aspect, the present invention provides a braking mechanism for use in a lifeline system including a lifeline, a shaft having a first axis, and a hub connected to the shaft to rotate with the shaft. The lifeline is coiled around the hub. The hub is rotatable with the shaft in a first direction during extension of the lifeline and in a second direction, opposite of the first direction, during retraction of the lifeline. The lifeline system further includes an abutment member. The braking mechanism includes a catch including a slot through which the shaft can pass, an element having or defining a second axis about which the catch is rotatable that is not concentric with a first axis defined by the shaft. The element is operatively connected to the shaft so that the element rotates about the first axis in the same direction as the hub when the hub is rotating about the first axis. A center of mass of the catch is located in the vicinity of the second axis of the element. The catch further includes at least one abutment section in the vicinity of a perimeter of the catch. The catch rotates about the second axis in the second direction when the shaft is rotated in the first direction at at least a determined angular acceleration to cause the abutment section of the catch to move radially outward relative to the shaft a sufficient amount to abut the abutment member of the lifeline system and stop the rotation of the shaft. A center of mass of the catch can be located generally upon or coincide with the second axis.

In a further aspect, the present invention provides a method of providing a braking function in a lifeline system as described above. In that regard, the lifeline system includes lifeline and a drum assembly around which the lifeline is coiled. The drum assembly is rotatable about a first axis in a first direction during extension of the lifeline and in a second direction, opposite of the first direction, during retraction of the lifeline. A tensioning mechanism is in operative connection with the drum assembly to impart a biasing force on the drum assembly to bias the drum assembly to rotate about the first axis in the second direction. The lifeline system also include and an abutment member.

The method includes placing a braking mechanism in operative connection with the drum assembly of the lifeline system, wherein the braking mechanism include a catch that is rotatable relative to the drum assembly about a second axis that is not concentric with the first axis. The second axis is operatively connected to the first axis so that the second axis rotates about the first axis in the same direction as the drum assembly when the drum assembly is rotating about the first axis. A center of mass of the catch is located in the vicinity of the second axis. The catch rotates about the second axis in the second direction when the drum assembly is rotated in the first direction at at least a determined angular acceleration to cause an abutment section of the catch to move radially outward (relative to the first axis) a sufficient amount to abut an abutment member of the lifeline system and stop the rotation of the drum assembly.

The catch can be biased against rotating in the second direction. A biasing force applied to the catch can, for example, be balanced against rotational inertia of the catch so that catch rotates in the second direction only when the lifeline is extended at an accelerating rate corresponding to the determined angular acceleration of the drum assembly.

The method can further include providing at least one abutment element to limit rotation of the catch in the first direction and limit rotation of the catch in the second direction.

Thus, in several embodiments, the present invention provides acceleration-actuated stop, brake or catch devices, systems or methods for self retracting lifeline systems used for personal fall protection. Self-retracting lifeline systems of the present invention allow a user to move about freely by releasing or retracting a lifeline as needed. However, if the user were to fall, the stop, brake or catch devices or systems of the present invention lock the drum assembly of the self-retracting lifeline to reduce the fall distance. The braking devices, systems and/or methods of the present invention are significantly less complex, less costly and more rugged than brake mechanisms found on currently available self-retracting lifeline systems.

The present invention, along with the attributes and attendant advantages thereof, will best be appreciated and understood in view of the following detailed description taken in conjunction with the accompanying drawings.

DETAILED DESCRIPTION OF THE INVENTION

As used herein and in the appended claims, the singular forms "a," "an", and "the" include plural references unless the content clearly dictates otherwise. Thus, for example, reference to "a connector" includes a plurality of such connectors and equivalents thereof known to those skilled in the art, and so forth, and reference to "the connector" is a reference to one or more such connectors and equivalents thereof known to those skilled in the art, and so forth.

Figure 1:
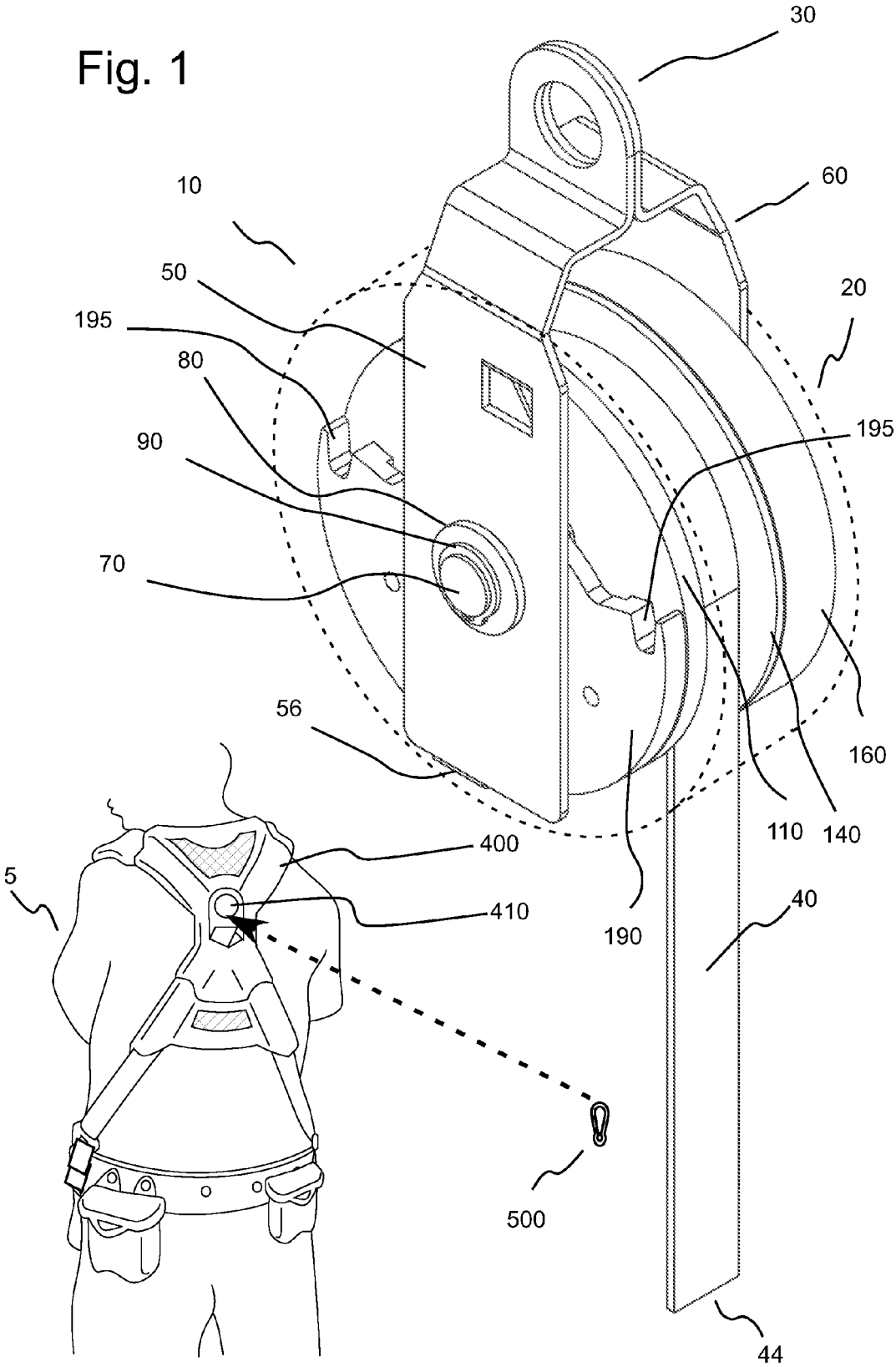
FIG. 1 illustrates a perspective view of an embodiment of a self-retracting lifeline system of the present invention wherein the outer housing is shown schematically in dashed lines.

FIG. 1 illustrates one embodiment of a self-retracting lifeline system 10 of the present invention wherein an outside cover or housing 20 is shown schematically in dashed lines. Cover 20 (which can, for example, be formed in two halves or housing members as known in the art) serves to protect internal mechanisms of self-retracting lifeline from damage, but otherwise does not significantly affect the operation of such internal mechanisms. In normal use, self-retracting lifeline 10 can, for example, be connected via a connector 30 to some fixed object. A distal end 44 of lifeline or lifeline web 40 (for example, a polymeric web material as known in the art) can, for example, be connected to a harness 400 worn by the user 5 (see FIG. 1). Alternatively, connector 30 can be connected to the user (for example, to D-ring 410 via a snap ring or carabiner 500) and distal end 44 of lifeline web 40 can be attached to some fixed object.

Figure 2:
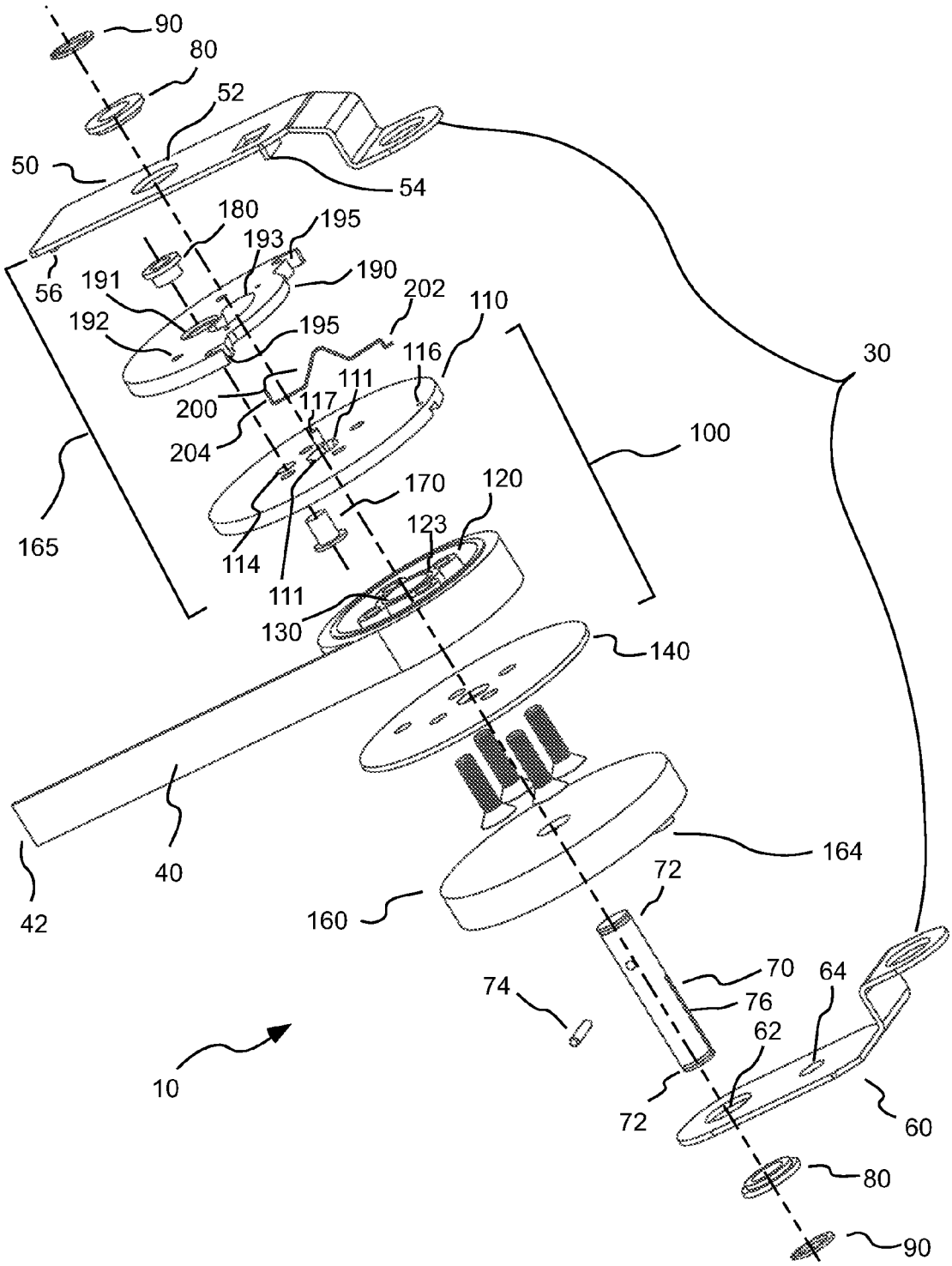
FIG. 2 illustrates an exploded or disassembled perspective view of the self-retracting lifeline system of FIG. 1.

FIG. 2 illustrates components of self-retracting lifeline system 10 in a disassembled state. Housing 20 is excluded in FIG. 2. A number of components rotate relative to frame members 50 and 60 on or with a shaft 70. Frame members 50 and 60 can, for example, be formed from a metal such as stainless steel or aluminum, and shaft 70 can, for example, be formed from a metal such as stainless steel. Shaft 70 rotates within shaft bushings 80 that are seated within holes 52 and 62 of frame members 50 and 60 respectively. Retainers such as snap rings 90 cooperate with seatings 72 on shaft 70 to retain shaft 70 in rotatable connection with bushings 80.

A hub or drum assembly 100 includes a first hub flange or plate 110, a hub or drum 120 around which lifeline web 40 is coiled, a web sleeve 130 (see, for example, FIG. 2), a second hub flange 140, and connectors such as screws 150. Hubs and drum assemblies suitable for use in the present invention are, for example, described in PCT International Patent Application No. PCT/US09/34981 entitled ENERGY ABSORBING LIFELINE SYSTEMS, filed Feb. 24, 2009 When assembled, hub plate 110, hub 120, hub flange 140, and screws 150 form hub or drum assembly 100 which rotates with shaft 70. A loop end of the lifeline web 40 can, for example, surround web sleeve 130 (which is positioned with a passage 123 formed within hub 120) and shaft 70, thereby anchoring the loop end securely within drum assembly 100. The loop end can, for example, extend through a slot (not shown) formed in hub 120 (in connection or communication with passage 123) and a portion of lifeline web 40 is coiled around hub 120, leaving a free distal end 44 which extends from housing 20 and (for example) attaches to the user through suitable hardware (for example, through an end connector which cooperates with connector 500 and D-ring 410). Alternatively, free distal end 44 can attach to some fixed point while self-retracting lifeline system 10 is attached to the user as described above.

As common with self-retracting lifelines, tension can be applied to drum assembly 100 to retract lifeline web 40 after extension thereof. In that regard, shaft 70 can be rotationally locked to hub or drum assembly 100 via hub plate 110 (which can also act as a catch or braking base as described below) by a shaft pin 74 which engages slots 111 in hub plate 110. A power spring assembly 160 can include a conventional coiled strap of spring steel (not illustrated in detail in FIGS. 1 through 7) inside a plastic housing. One end of the spring steel strap can be anchored to housing 20. Another end 166 (see FIG. 3B) can engage a slot 76 (see FIG. 2) in shaft 70. The housing of power spring assembly 160 can, for example, be rotationally locked to frame 60 by a stud 164 on the housing engaging a hole 64 in frame 60. As described above, lifeline web 40 is anchored to and coiled around hub 120. At assembly, the power spring is "wound up" to provide torque to shaft 70 and thus to hub or drum assembly 100. The torque applied to shaft 70 pre-tensions lifeline web 40 and causes lifeline web 40 to coil up or retract around hub 120 after it has been uncoiled therefrom (that is, pulled out or extended from housing 20).

Self-retracting lifeline system 10 also includes a braking mechanism indicated generally by reference 165 in FIG. 2. In that regard, a catch pivot 170 can be mounted in and extend through a passage 114 in hub plate/catch base 110 to provide a pivot axis or shaft for a catch bushing 180 and a catch 190 (which can, for example, be formed from a metal such as cast stainless steel). In the illustrated embodiment, catch 190 has a diameter or width approximately equal to the diameter of hub plate/catch base 110. Catch bushing 180 passes through a passage 191 formed in catch 190 to cooperate with catch pivot 170. Braking mechanism 165 can also includes a biasing mechanism or device such as a generally V-shaped catch spring 200 having one end 202 which engages a hole 116 in the hub plate/catch base 110 and another end 204 which engages a hole 192 in catch 190.

Figure 3A:
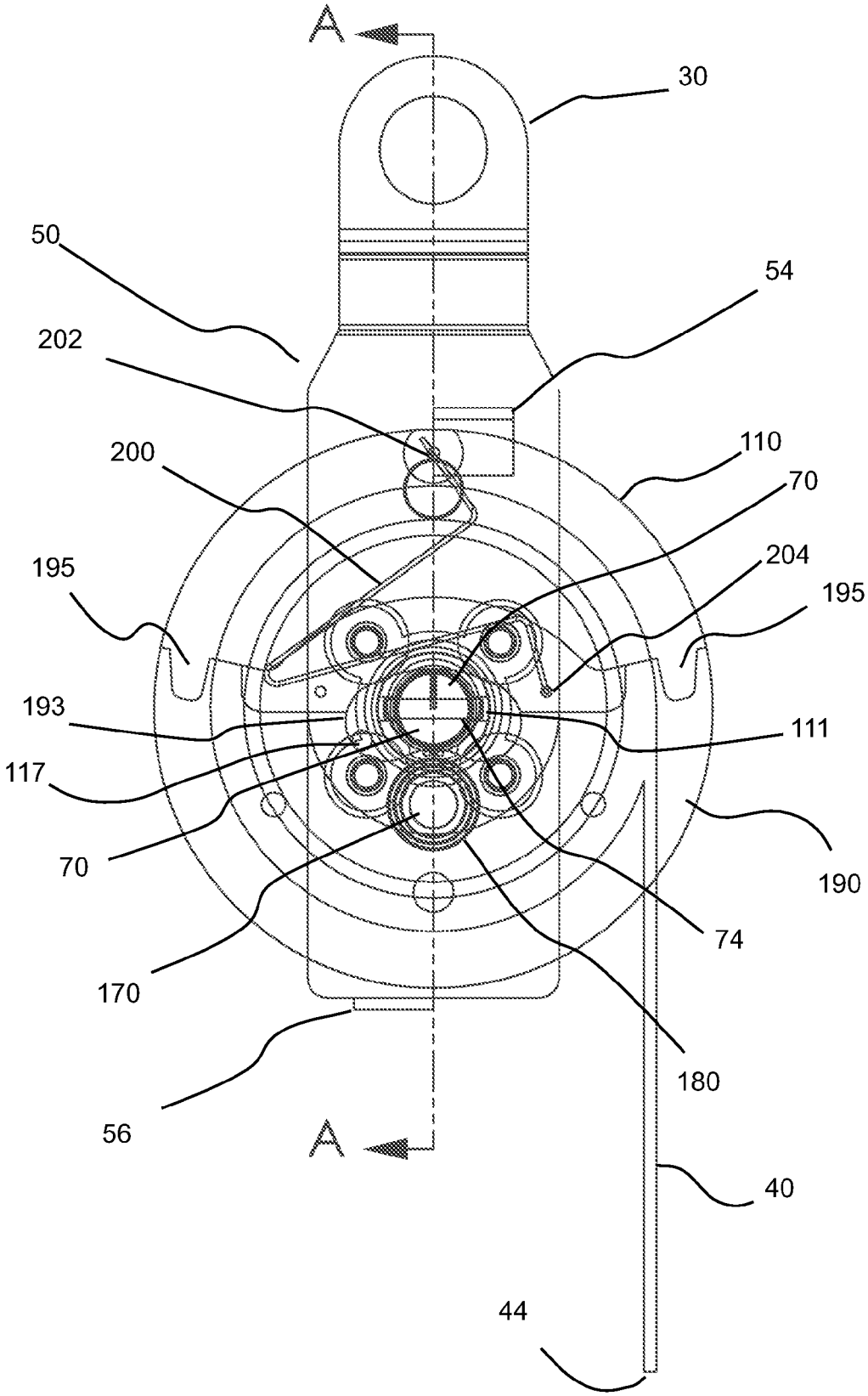
FIG. 3A illustrates a front, transparent view of the self-retracting lifeline system of FIG. 1.
Figure 3B:
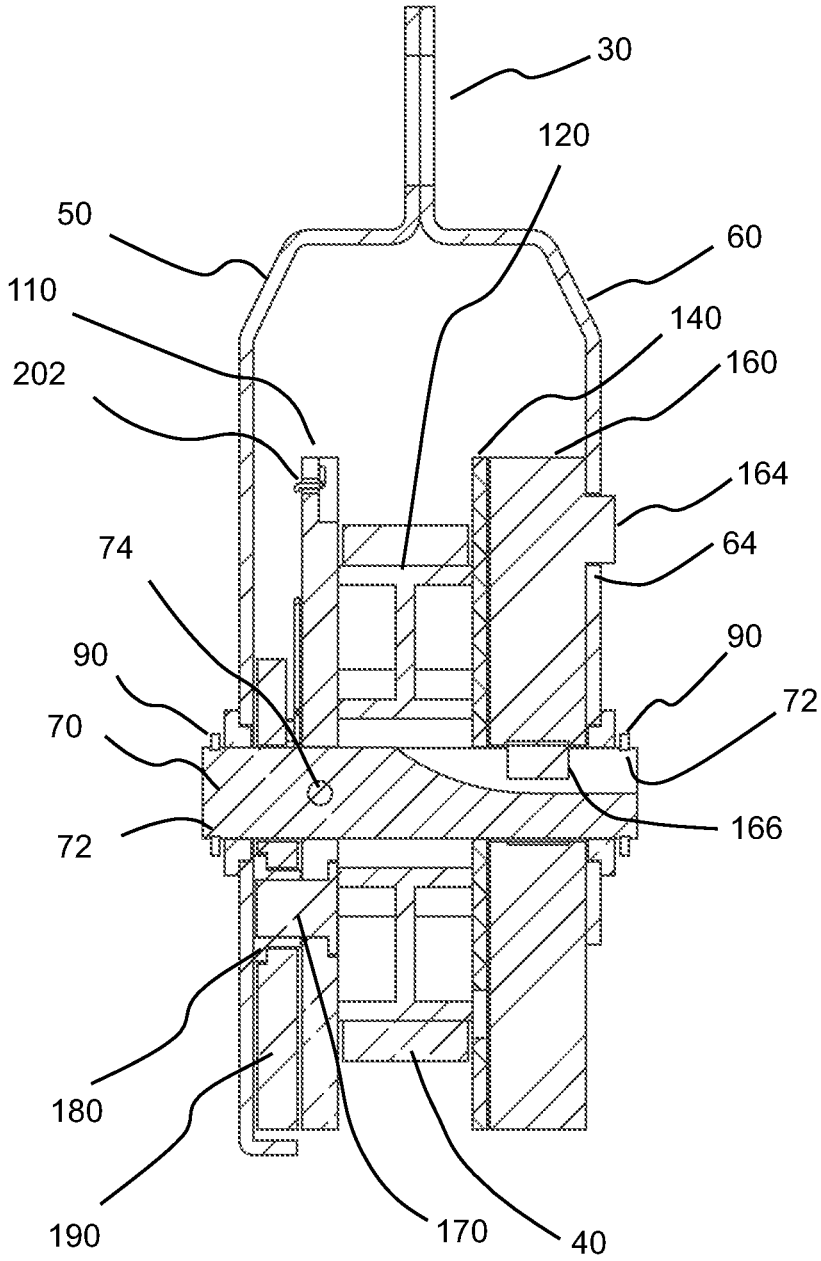
FIG. 3B illustrates a cross-sectional view of the self-retracting lifeline system along section A-A as set forth in FIG. 3A.

FIG. 3A illustrates a transparent or hidden line view of self-retracting lifeline 10, while FIG. 3B illustrates a cross-sectional view self-retracting lifeline 10 along section A-A set forth in FIG. 3A. Shaft 70 is rotationally locked to the hub plate or catch base 110 by shaft pin 74 engaging slots 111 in the catch base 110 as described above. To avoid confusion and/or crowding, not all elements are labeled in FIGS. 3A through 7.

Figure 4:
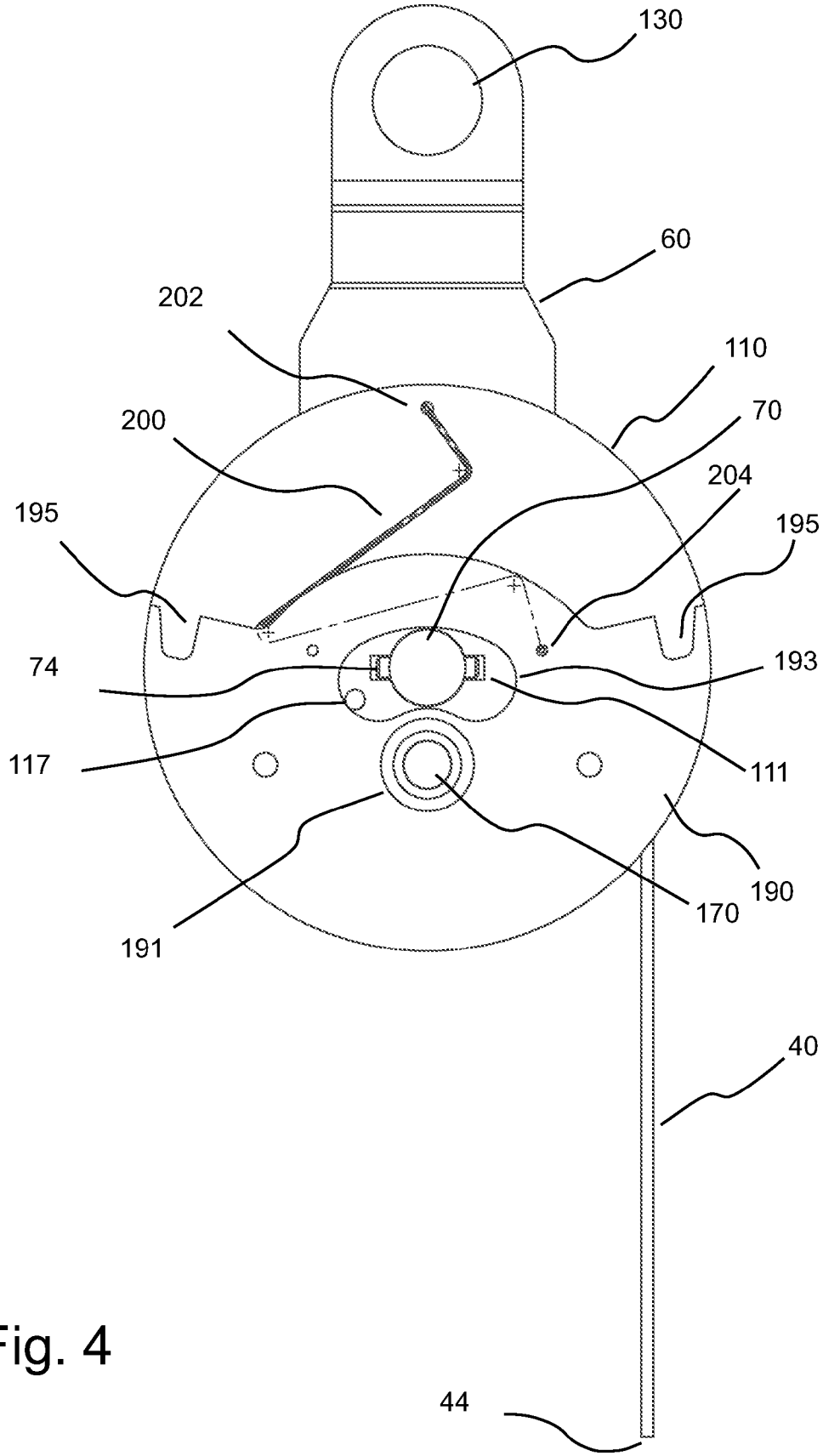
FIG. 4 illustrates the self-retracting lifeline system wherein a catch is rotating with the drum assembly.

FIG. 4 illustrates self-retracting lifeline 10 wherein snap ring 90, bushing 80, frame member 50 and catch bushing 180 are hidden. Ends 202 and 204 of catch spring 200 are visible, while catch spring 200 is partially hidden. The two legs of catch spring 200 exert a biasing force tending to cause catch 190 to rotate in a first direction (for example, clockwise in the illustrated embodiment) or tending to prevent catch 190 from rotating in an opposite second direction about the axis of catch pivot 170 and relative to hub plate or catch base 110. In FIG. 4, catch 190 is rotated as far clockwise relative to hub plate or catch base 110 that it can rotate since an abutment element or stud 117 on hub plate or catch base 110 contacts a side of a generally kidney-shaped slot 193 formed in catch 190.

Figure 5:
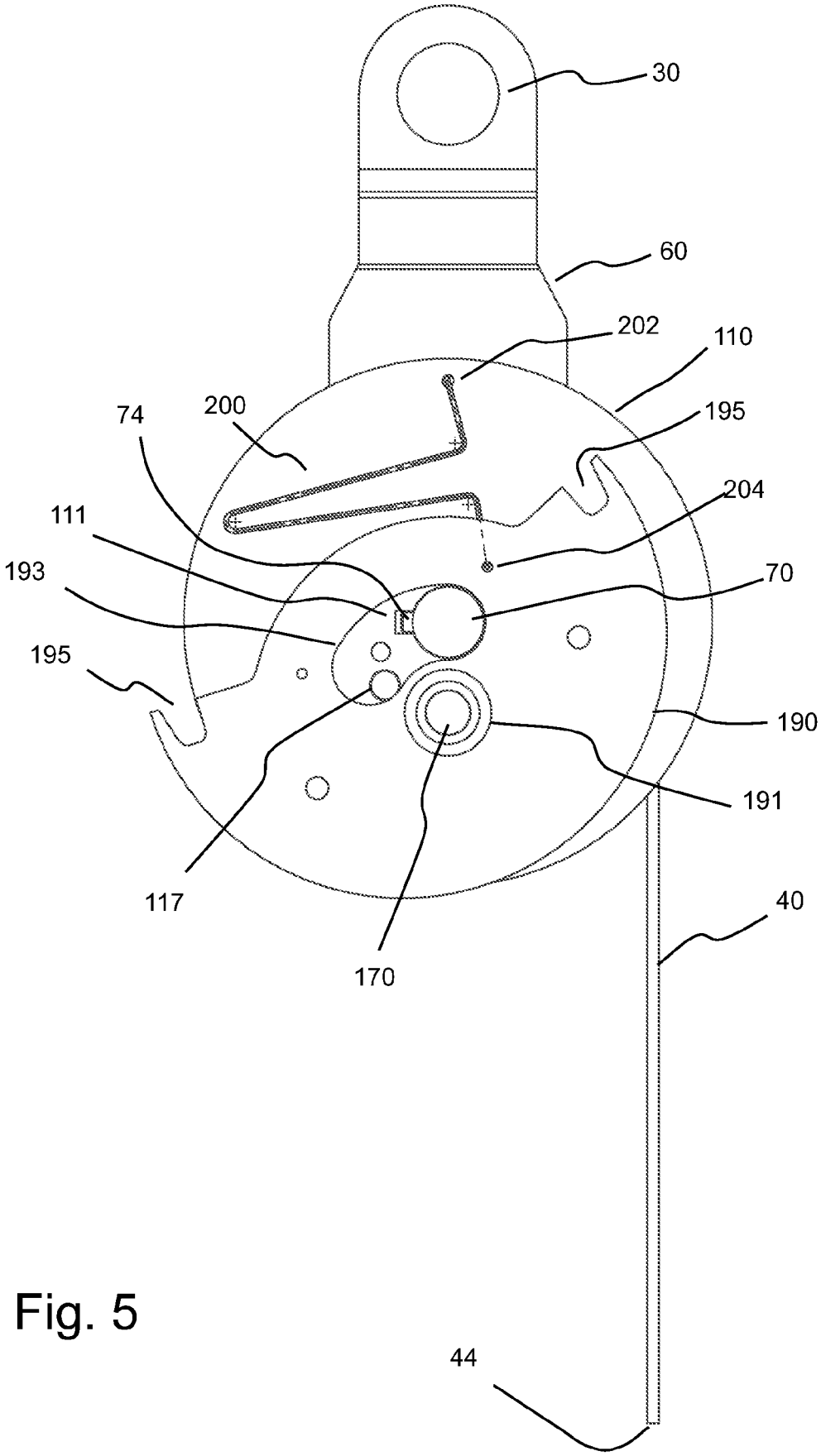
FIG. 5 illustrates the self-retracting lifeline system wherein the lifeline is being extended from the self-retracting lifeline system at a sufficient acceleration so that the catch rotates in the opposite direction of the drum assembly.

The center of mass of catch 190 is located in the vicinity of or generally at the axis about which it pivots or rotates on catch pivot 170. Preferably, the axis of catch pivot 170 is located at or as close as possible to the center of mass of catch 190. Catch 190 will thus maintain its position relative to catch base 110 when hub assembly 100 is rotating at a constant angular velocity as when lifeline web 40 is being pulled out of self-retracting lifeline 10 at a constant rate. That is, catch 190 and hub plate/catch base 110 will rotate as a unit and centrifugal force will not cause catch 190 to rotate (about catch pivot 170) relative to hub plate/catch base 110. However, if hub assembly 100 experiences a clockwise angular acceleration (as is the case when lifeline web 40 is being pulled out of self-retracting lifeline 10 at an increasing rate) sufficiently high for the rotational inertia of catch 190 to overcome the force of catch spring 200, catch 190 will rotate about catch pivot 170 in a second direction (counterclockwise in the illustrated embodiment) relative to hub plate/catch base 110. This condition is illustrated in FIG. 5.

Analogous to the behavior of a mass having a linear velocity, a rotating mass will tend to keep rotating at a constant rotational velocity unless acted upon by some external torque according to the equation $T=I\times\alpha$, where I is the rotational moment of inertia of the mass and $\alpha$ is its rotational acceleration.

In a familiar example, one could be standing on a merry-go-round holding a bicycle wheel by its axle with the axis in a vertical orientation. Assume the axle bearings are frictionless and the initial rotational velocities of the wheel and the merry-go-round are zero. Also assume that one of the spokes of the bicycle wheel happens to be pointing due north. If the merry-go-round were to begin rotationally accelerating clockwise to some new rotational velocity, the bicycle wheel would be observed to begin rotating counter-clockwise relative to the person holding it but the spoke would still be pointing due north. The wheel would be translating in a circular path but it would not be rotating. The bicycle wheel is "left behind" rotationally because it is maintaining its initial zero rotational velocity. If the person holding the bicycle wheel grabbed the rim of the wheel, it would provide the torque needed to bring the wheel "up to speed" to match the rotational velocity of the merry-go-round.

The axle of the wheel need not be collinear with the merry-go-round axis, but only parallel thereto. If the wheel is perfectly balanced with its center of mass at the center of the axle, the rotational velocity of the merry-go-round will not produce any torque (from centripetal forces) to act on the wheel.

In the case of catch 190, the center of mass of catch 190 is in the vicinity of or at the center of catch pivot 170. Thus, catch 190 will not tend to rotate relative to the hub assembly 100 as a result of centripetal forces, regardless of the rotational velocity of hub assembly 100.

When drum assembly 100 accelerates rotationally clockwise, catch 190 will also accelerate rotationally because the force of catch spring 200 is sufficient to provide the torque required to keep catch 190 in abutting contact with abutment element 117. However, if the rotational acceleration of drum assembly 100 is great enough, the torque supplied by the catch spring 200 will not be sufficient to prevent catch 190 from being "left behind" and moving/rotating to an extended, locking position as illustrated in FIG. 5.

In FIG. 5, snap ring 90, bushing 80, frame member 50 and catch bushing 180 are once again hidden. Catch 190 is shown to be rotated about catch pivot 170 counterclockwise relative to hub plate/catch base 110. In the illustrated embodiment, the counterclockwise rotation of catch 190 is limited by contact of one end of slot 193 with shaft 70. Because catch spring 200 ends (or attachment points 202 and 204), and catch pivot 170 are not in line, the force of catch spring 200 still exerts a force tending to move the catch back to its clockwise position relative to hub plate/catch base 110. Thus, once the clockwise angular acceleration of hub assembly 100 is reduced or ceases, catch 190 will rotate clockwise about catch pivot 170 and relative to hub plate/catch base 110 (that is, back to the position illustrated in FIG. 4).

When catch 190 is rotated counterclockwise about catch pivot 170 and relative to hub plate/catch base 110, an abutment section, stop section or corner 195 of catch 190 extends radially outward beyond the periphery of hub plate/catch base 110, because catch pivot 170 is not concentric with shaft 70.

Figure 6:
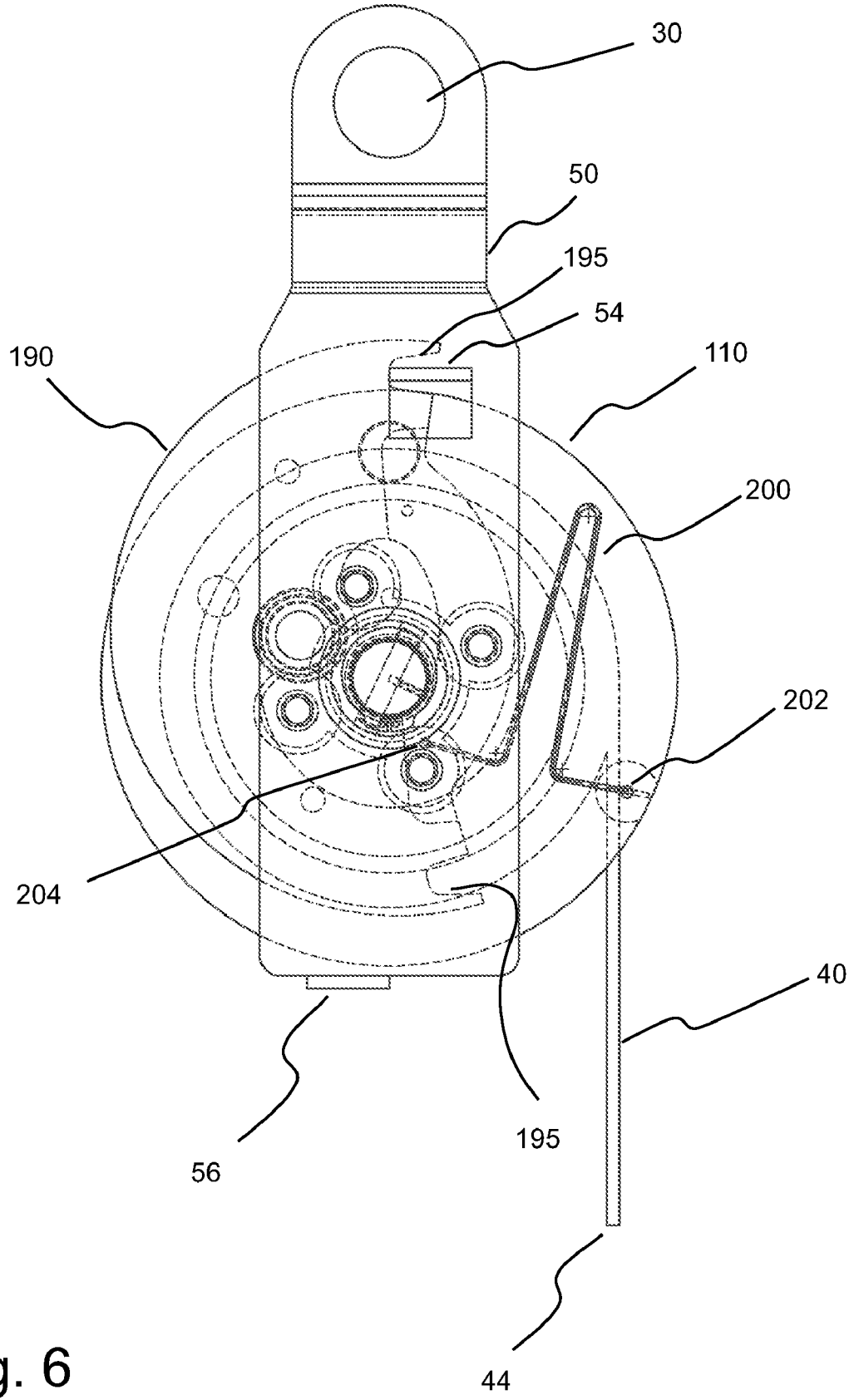
FIG. 6 illustrates the self-retracting lifeline system wherein a frame member thereof is partially transparent and the hub assembly has experienced a clockwise angular acceleration sufficient to cause the catch to rotate counter clockwise about a pivot relative to the hub plate or catch base so that an abutment section or corner of the catch has abutted or caught on one of two abutment members formed on the frame member.

FIG. 6 illustrates a hidden line view of self-retracting lifeline 10 wherein frame member 50 is shown as partially transparent. As illustrated in FIG. 6, hub assembly 100 has experienced a clockwise angular acceleration sufficient to cause catch 190 to rotate counterclockwise about catch pivot 170 and relative to hub plate/catch base 190. One of two abutment sections 195 of catch 190 is illustrated to have abutted or caught on one of two abutment members, stop members or tabs 54 and 56 extending from frame member 50 (see also FIG. 2). As a result, the rotation of hub assembly 100 is brought to a halt. Because there are two abutment members 54 and 56, hub assembly 100 will rotate at most ½ revolution after a sufficiently high angular acceleration is applied (as described above) before being stopped. Catch 190 thus operates to brake or stop rotation of drum assembly 100 (and connected shave 70) via direct abutment with stop members 54 and 56, without the requirement of complex interaction(s) with any other component.

In several embodiments, the biasing force exerted by catch spring 200 is balanced against the rotational inertia of catch 190 as described above so that catch 190 "actuates" only when lifeline web 40 is being pulled from self-retracting lanyard 10 at an accelerating rate corresponding, for example, to the beginning of a fall. For example, catch 190 and catch spring 200 can be readily designed (using engineering principles known to those skilled in the art) to actuate when lifeline web 40 is being pulled out at a certain determined (maximum or threshold) acceleration (for example, ½ or ¾ times the acceleration of gravity). From the maximum linear acceleration of lifeline web 40, the corresponding maximum drum rotational or angular acceleration is determined. The rotational moment of inertia of catch 90 determines the maximum torque that must be supplied by the catch spring 200. For linear/angular accelerations below the threshold accelerations or when the user is extending the web at a constant rate, such as when walking, catch 190 will not actuate and hub assembly 100 will turn freely.

Figure 7:
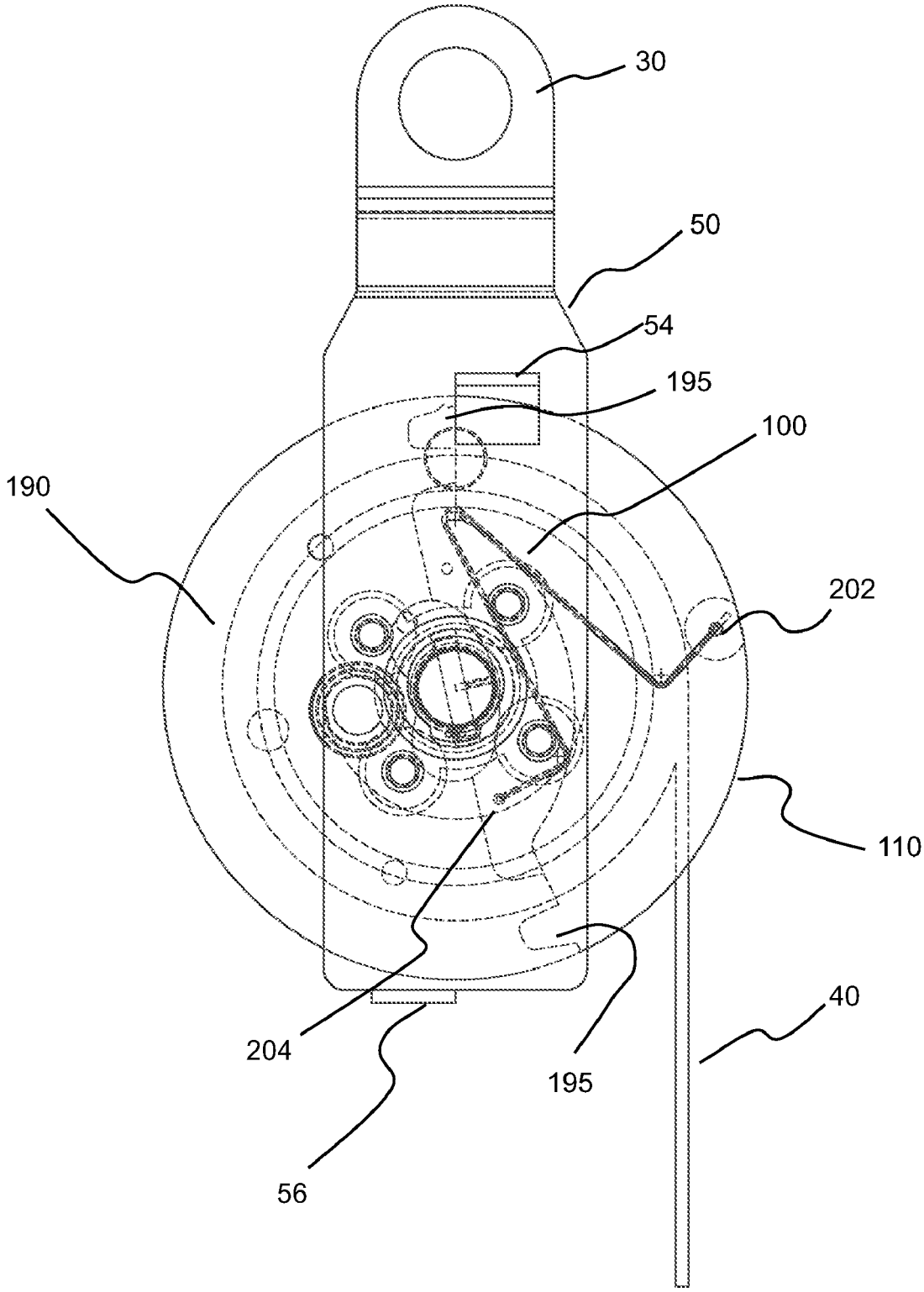
FIG. 7 illustrates the self-retracting lifeline system wherein frame member is again illustrated to be partially transparent and wherein the tension on the lifeline has been relaxed from the state of FIG. 6 to allow the hub assembly to retract the lifeline a short distance and wherein the abutment section of the catch has moved away from abutment with the abutment member of the frame member.

FIG. 7 illustrates self-retracting lifeline 10 wherein frame member 50 is again illustrated to be partially transparent. FIG. 7 illustrates a position of the components of self-retracting lifeline 10 in the case wherein, after being locked or braked as illustrated in FIG. 6, the user has relaxed the tension on lifeline web 40 to allow hub assembly 100 to retract lifeline web 40 a short distance. As hub assembly 100 rotates counterclockwise (as a result of the tensioning force of tensioning mechanism 160), abutment section 195 of catch 190 moves away from abutment with the abutment member or tab 54. Catch 190 then rotates (as a result of the biasing force of catch spring 200) clockwise about catch pivot 170 and relative to hub plate/catch base 110. At this point, hub assembly 100 is now free to rotate again.

Figure 8:
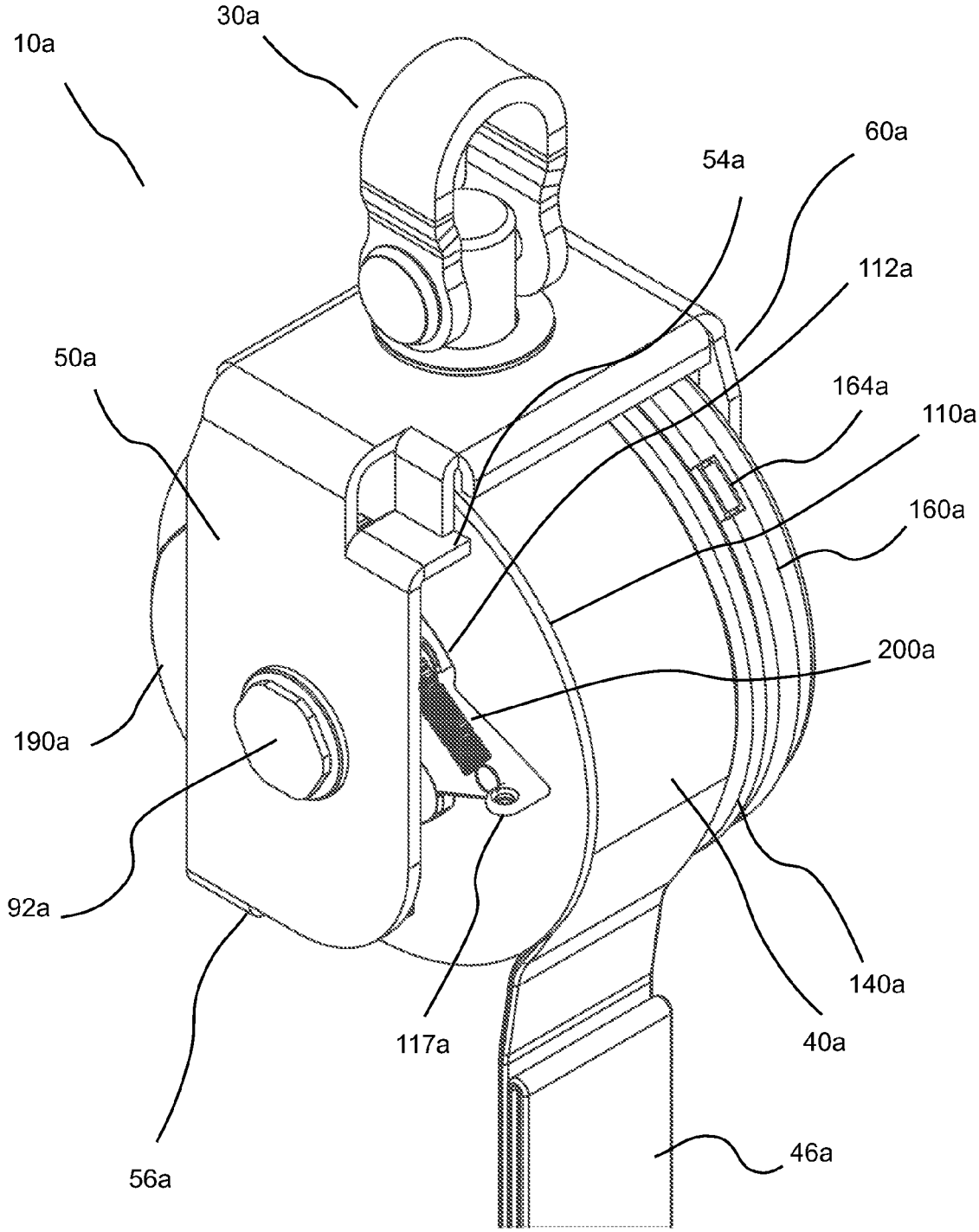
FIG. 8 illustrates a perspective view of another embodiment of a self-retracting lifeline system of the present invention wherein the outer housing has been removed.
Figure 9:
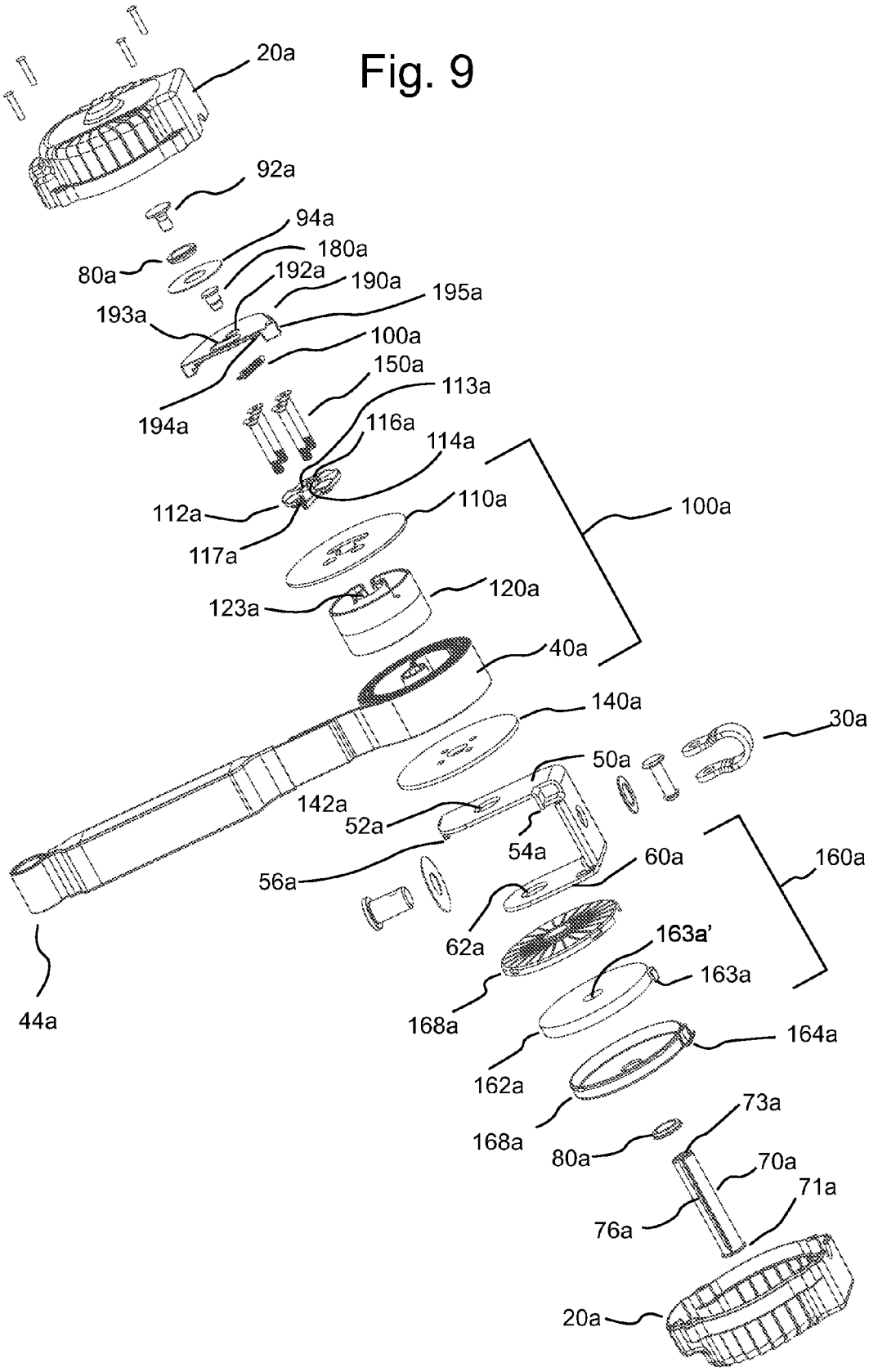
FIG. 9 illustrates an exploded or disassembled perspective view of the self-retracting lifeline system of FIG. 8.
Figure 10A:
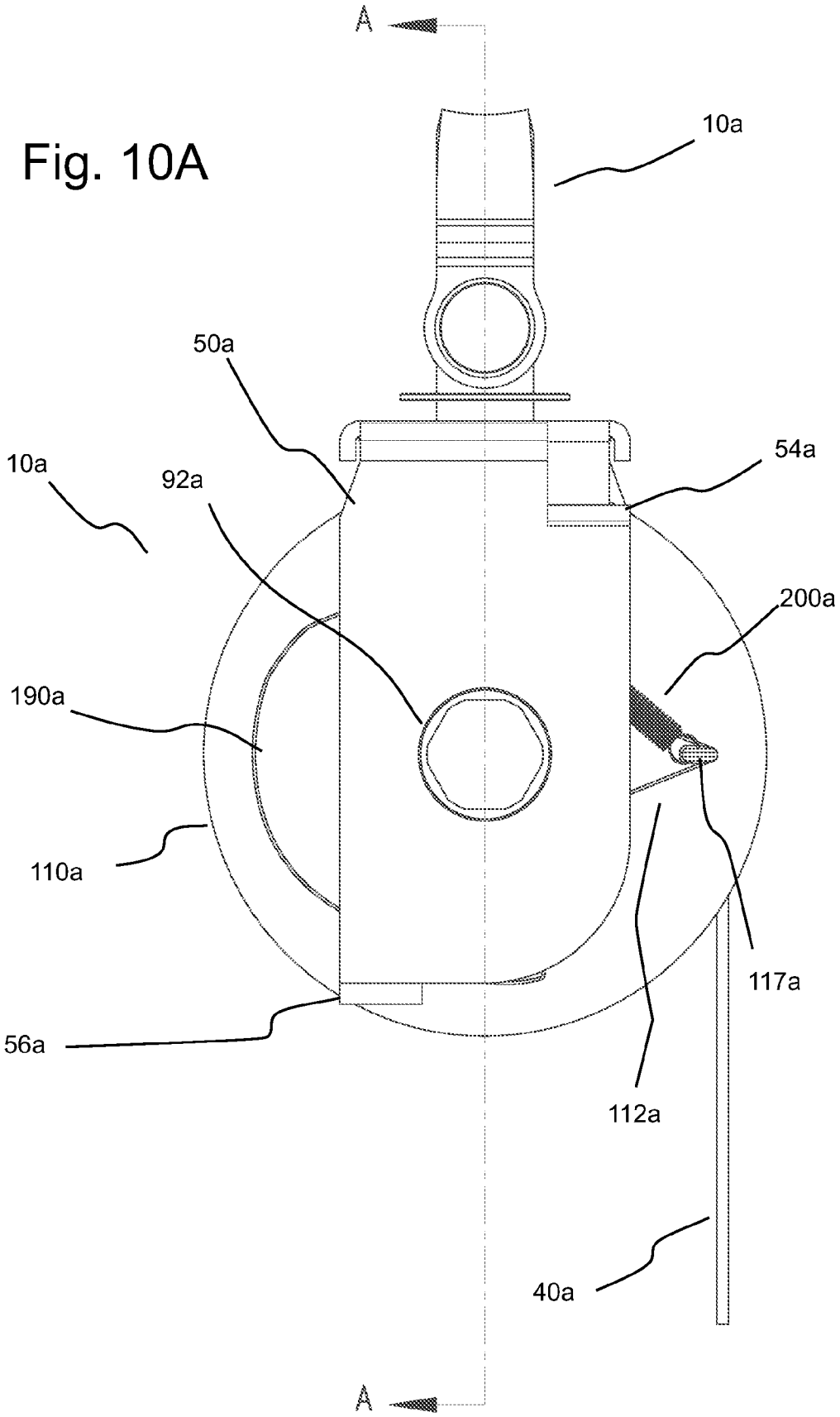
FIG. 10A illustrates a front view of the self-retracting lifeline system of FIG. 8.
Figure 10B:
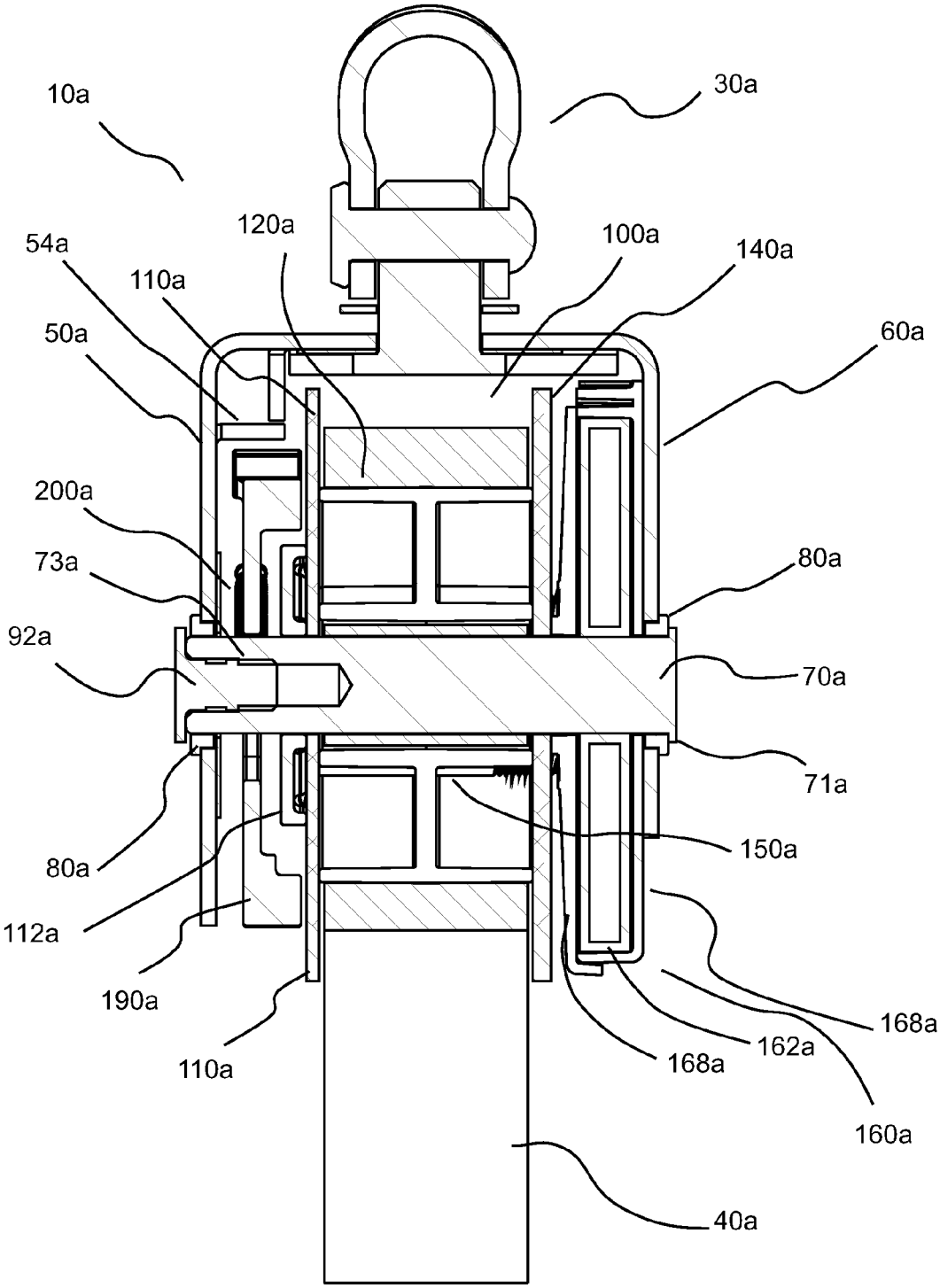
FIG. 10B illustrates a partially cross-sectional view of the self-retracting lifeline system along section A-A as set forth in FIG. 10A.

FIG. 8 illustrates another embodiment of a self-retracting lifeline system 10*a* of the present invention wherein an outside cover or housing has been removed. The cover can, for example, be formed by two connectible housing members 20*a* as illustrated in FIG. 9 and serves to protect internal mechanisms of self-retracting lifeline from damage as described in connection with self-retracting lifeline system 10. Self-retracting lifeline 10*a* of FIGS. 8 through 14 operates in a similar manner to self-retracting lifeline 10. In FIGS. 8 though 14, like elements of system 10*a* are designated similarly to corresponding elements of system 10 with the addition of the designation "a" thereto.

Self-retracting lifeline 10*a* can, for example, be connected via a connector 30*a* to some fixed object or anchor point. A distal end 44*a* of lifeline or lifeline web 40*a* can, for example, be connected to a harness 400 worn by the user 5 (see FIG. 1). Alternatively, connector 30*a* can be connected to the user and distal end 44*a* of lifeline web 40*a* can be attached to some fixed object.

FIG. 9 illustrates components of self-retracting lifeline system 10*a* in a disassembled state. As with self-retracting lifeline system 10, a number of components of self-retracting lifeline system 10*a* rotate relative to frame members 50*a* and 60*a* on or about a shaft 70*a*. In the embodiment of FIGS. 8 through 14, frame members 50*a* and 60*a* are formed integrally as part of a U-shaped length of metal (for example, stainless steel). Shaft 70*a* (formed, for example, from a metal such as stainless steel) rotates within passages 52*a* and 62*a* of frame members 50*a* and 60*a* respectively. Shaft 70*a* can, for example, rotate within shaft bushings 80*a* that are seated within holes 52*a* and 62*a* of frame members 50*a* and 60*a* respectively. A flanged retainer such as a threaded member 92*a* cooperates with a threaded passage 73*a* formed in shaft 70*a* to retain shaft 70*a* in rotatable connection with frame members 50*a* and 60*a*. A flange 71*a* on one end of shaft 70*a* can, for example, abut frame member 60*a*. A washer 94*a* can, for example, be provided to cooperate with threaded member 92*a* to retain shaft 70*a* in operative connection with frame members 50*a* and 60*a*.

Hub or drum assembly 100*a* of system 10A includes a first hub flange or plate 110*a*, a hub or drum 120*a* around which lifeline web 40*a* is coiled, a second hub flange 140*a*, and connectors such as screws 150*a* (which are oriented in the opposite direction as screws 150 of system 10). When assembled, hub plate 110*a*, hub 120*a*, hub flange 140*a*, and screws 150*a* form hub or drum assembly 100*a* which rotates with shaft 70*a*. Drum 120*a* is of decreased diameter and increased width as compared to drum 120 to accommodate a webbing that is approximately 25 mm wide (as compared to drum 120*a*, which is designed for use with webbing that is approximately 17 mm wide). A loop end 42*a* of the lifeline is positioned within a passage 123*a* formed within hub 120*a* around shaft 70*a* to anchor loop end 42*a* securely within drum assembly 100*a*. Loop end 42*a* extends through a slot 121*a* formed in hub 120*a* and a portion of lifeline web 40*a* is coiled around hub 120*a*, leaving a free end 44*a* which extends from housing 20. Lifeline web 40*a* can also include an energy absorbing portion or section 46*a* in which, for example, a length of lifeline web 40*a* is folded back on itself and sewn or stitched as know in the fall protection arts. In the case of a fall, the stitching of the energy absorbing portion 46*a* tears to absorb energy.

Shaft 70*a* is rotationally locked to hub plate 110 via a catch or braking base 112*a* (formed, for example, from a metal such as cast stainless steel) that is connected to hub plate 110*a* by screws 150*a*. In that regard, braking base 112*a* includes a passage 113*a* formed therein through which shaft 70*a* passes and a radially inward projecting member 114*a* which engages a radially outward portion of slot 76*a* in hub plate 110. Tension is applied to drum assembly 100*a* to retract lifeline 40*a* after extension thereof via a power spring assembly 160*a* including coiled strap of spring steel 162*a* inside a plastic housing formed by housing members 168*a*. A radially outward end 163*a* of spring steel strap can be anchored to frame 60*a*. A radially inward end 163*a*' can engage a radially inward, narrow portion of slot 76*a* in shaft 70*a*. One housing member 168*a* of power spring assembly 160 can, for example, be rotationally locked to frame 60 by a projecting member or stud 164*a* on housing member 168*a* which engages a abutment member 64*a* in frame 60*a*. As described above, lifeline web 40*a* is anchored to and coiled around hub 120*a* of drum assembly 100*a*. At assembly, power spring 162*a* is "wound up" to provide torque to shaft 70*a* and thus to drum assembly 100*a*. The torque applied to shaft 70*a* pretensions lifeline web 40 and causes lifeline web 40 to coil up or retract around hub 120*a* after it has been uncoiled therefrom as described above in connection with self-retracting lanyard system 10.

Like self-retracting lifeline system 10, self-retracting lifeline system 10*a* includes a braking mechanism. In that regard, a catch 190*a* (formed, for example, from a metal such as cast stainless steel) is pivotably or rotatably mounted (eccentric to the axis of shaft 70*a*) via a partially threaded member 180*a* which passes through a passage 192*a* formed in catch 190*a* to connect to brake or catch base 112*a* via a threaded passage 116*a* formed in catch base 112*a*. As described above in connection with catch 190, the axis of pivot member 180*a* (and passage 192*a*) preferably corresponds generally to the center of mass of catch 190*a*. The braking mechanism can also include a catch spring 200 having one end which engages a connector 117*a* in catch base 112*a* and another end which engages a connector 194*a* in catch 190*a*. The force exerted by the catch spring 200*a* is generally balanced against the rotational inertia of catch 190*a* so that catch 190*a* actuates (via centrifugal force) to effect braking only when lifeline web 40*a* is being pulled from self-retracting lifeline system 10*a* at an acceleration rate corresponding, for example, to the beginning of a fall.

Figure 11:
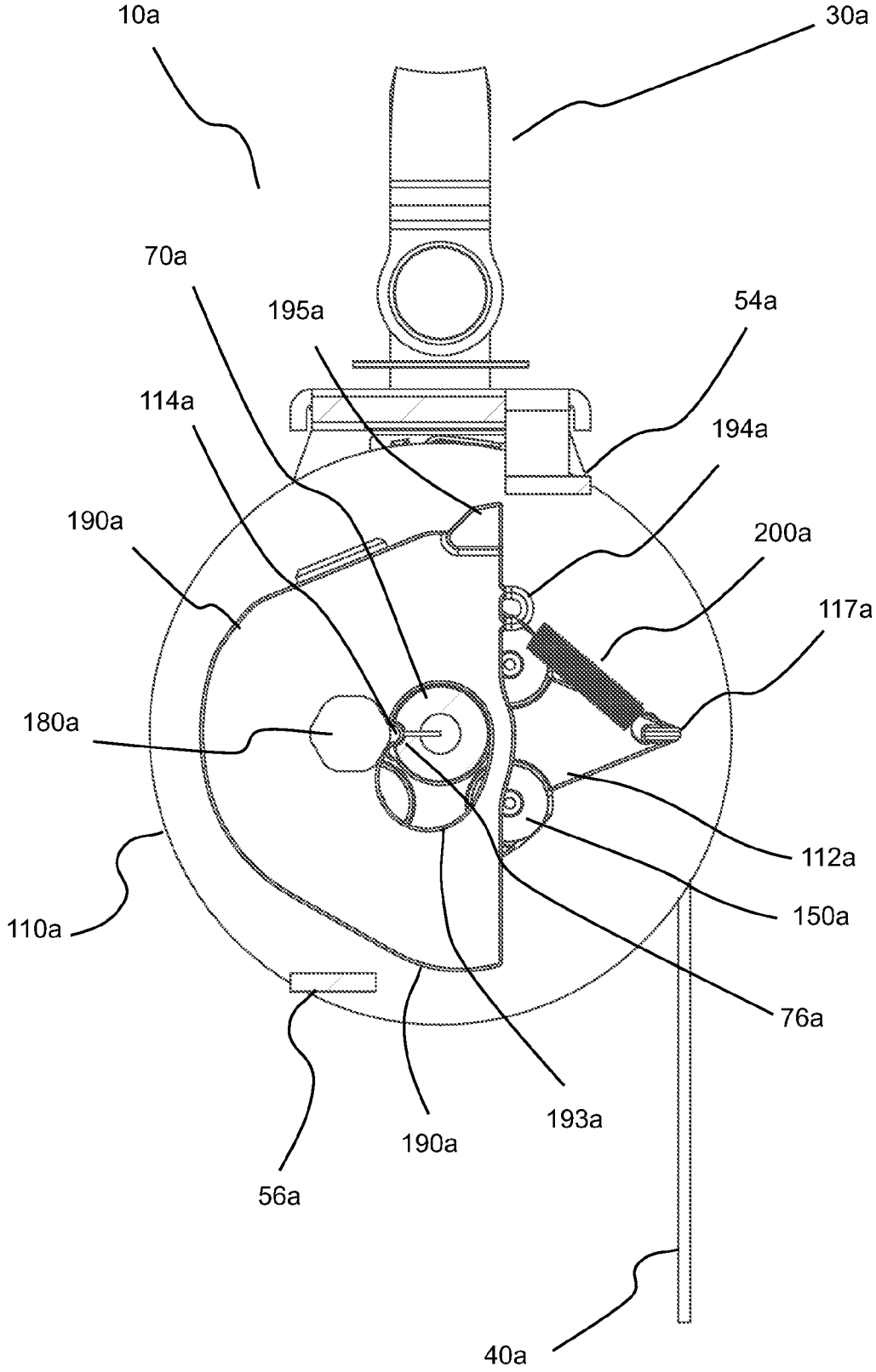
FIG. 11 illustrates the self-retracting lifeline system of FIG. 8 wherein a catch is rotating with the drum assembly.
Figure 12:
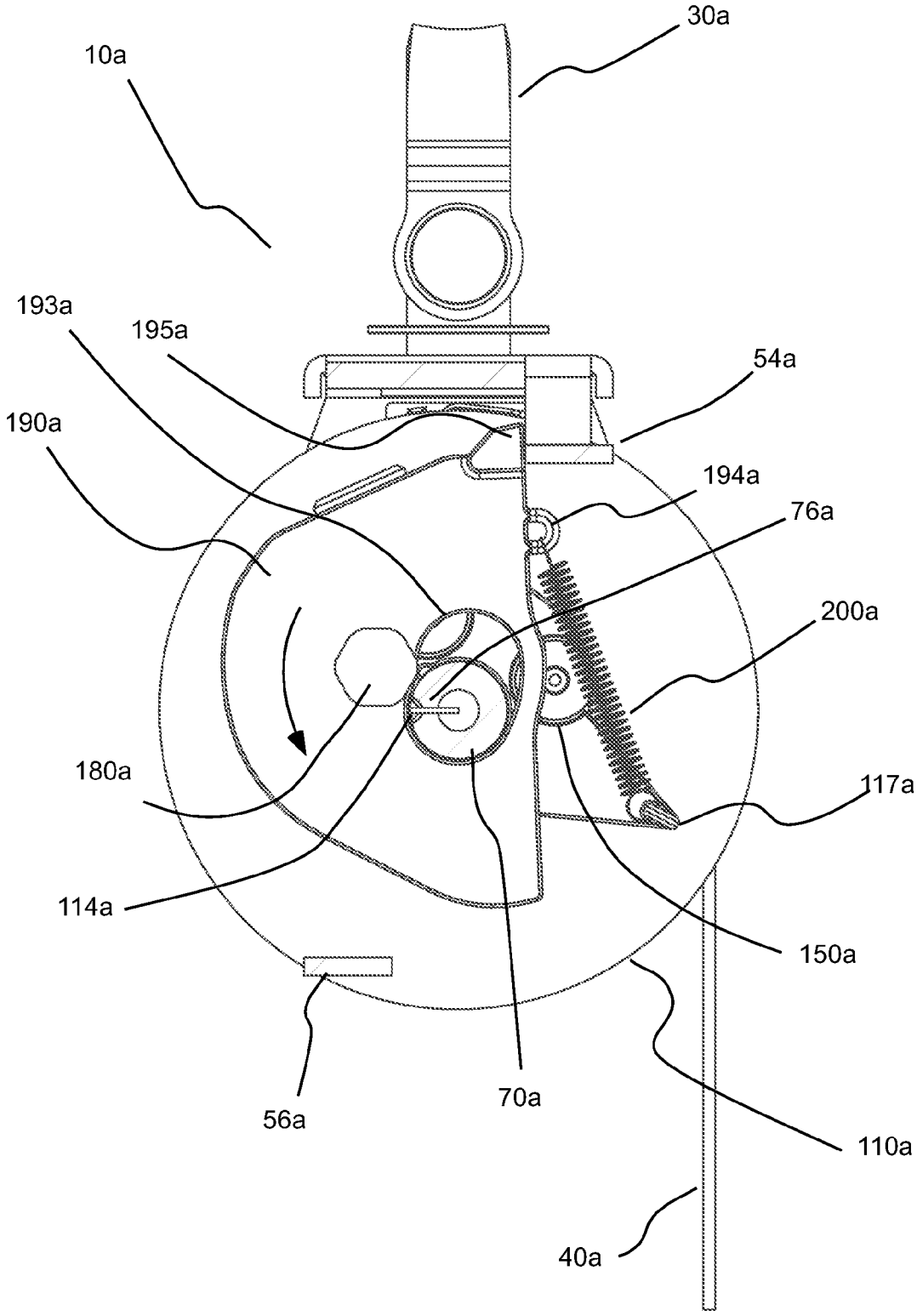
FIG. 12 illustrates the self-retracting lifeline system of FIG. 8 wherein the lifeline is being extended from the self-retracting lifeline system at a sufficient acceleration so that the catch rotates about a pivot member in the opposite direction of the rotation of drum assembly about a shaft.

As described above, shaft 70*a* is rotationally locked to the catch base 112*a* and thereby to drum assembly 100*a*. FIGS. 11 and 12 illustrate self-retracting lifeline 10*a* wherein connector 92*a*, washer 94*a*, bushing 80*a* and frame member 50*a* are hidden. Catch spring 200*a* exerts a biasing force tending to cause catch 190*a* to rotate in a first direction (for example, clockwise in the illustrated embodiment) or, equivalently, biasing against rotation in a second, opposite direction, on pivot member 180*a* relative to hub assembly 100*a*. In FIG. 11, catch 190*a* is rotated as far clockwise relative to hub assembly 100*a* that it can rotate to a point wherein shaft 70*a* abuts a first edge, side or end of an elongated, generally kidney-shaped, arced or curved slot 193*a* formed in catch 190*a*. Thus, catch spring 200*a* biases catch 190*a* against shaft 70*a*.

The center of mass of catch 190*a* is located generally where it pivots or rotates on pivot member 180*a*. Catch 190*a* will thus maintain its position relative to hub assembly 100*a*, while hub assembly 100*a* is rotating at a constant angular velocity as when lifeline web 40*a* is being pulled out of self-retracting lifeline 10*a* at a constant rate. That is, catch 190*a* and catch base 112*a*/hub assembly 100*a* will rotate as a unit and centrifugal force will not cause catch 190*a* to rotate about pivot member 180*a* relative to catch base 112*a*/hub assembly 100*a*. However, if hub assembly 100*a* experiences a clockwise (in the orientation of FIGS. 11 through 14) angular acceleration (as is the case when lifeline web 40*a* is being pulled out of self-retracting lifeline 10*a* at an increasing rate) sufficiently high for the rotational inertia of catch 190*a* to overcome the force of catch spring 200*a*, catch 190*a* will rotate about pivot member 180*a* in a second direction (counterclockwise in the illustrated embodiment) relative to catch base 112*a*/hub assembly 100*a*. This condition is illustrated in FIG. 12.

In FIG. 12, catch 190*a* is shown to be rotated about pivot member 180*a* counterclockwise relative to hub assembly 100*a*. In the illustrated embodiment, the counterclockwise rotation of catch 190*a* is limited by contact of a second end of slot 193*a* with shaft 70*a*. Because catch spring 200*a* ends and pivot member 180*a* are not in line, the force of catch spring 200*a* still exerts a force tending to move catch 190 back to its clockwise (non-actuated) position (see FIG. 11) relative to hub assembly 100. Thus, once the clockwise angular acceleration of hub assembly 100*a* is reduced or ceases, catch 190*a* will rotate clockwise relative to hub assembly 100*a* (that is, back to the non-actuated position illustrated in FIG. 11).

When catch 190*a* is rotated counterclockwise about pivot member 180*a* relative to hub assembly 100*a*, an abutment section, stop section or corner 195*a* of catch 190*a* extends radially outward (because catch pivot 180*a* is not concentric with shaft 70*a*).

Figure 13:
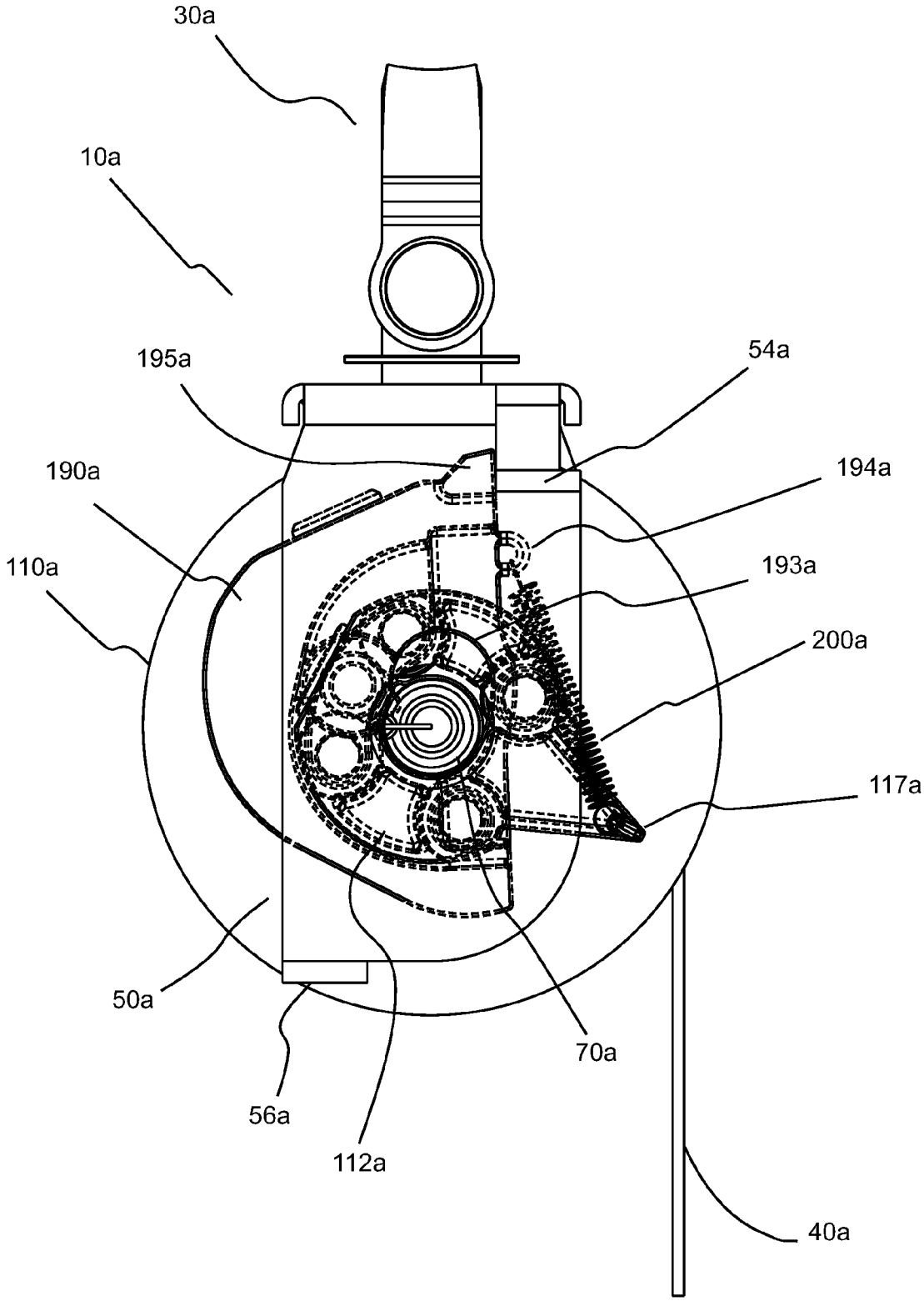
FIG. 13 illustrates the self-retracting lifeline system of FIG. 8 wherein a frame member thereof is partially transparent and the hub assembly has experienced a clockwise angular acceleration sufficient to cause the catch to rotate counter clockwise relative to the hub plate or catch base so that an abutment section or corner of the catch has abutted or caught on one of two abutment members formed on the frame member.

FIG. 13 illustrates a hidden line view of self-retracting lifeline 10*a* wherein frame member 50*a* is shown as partially transparent. As illustrated in FIG. 13, hub assembly 100*a* has experienced a clockwise angular acceleration sufficient to cause catch 190*a* to rotate counterclockwise relative to hub assembly 100*a*. An abutment section 195*a* of catch 190*a* is illustrated to have abutted or caught on one of two abutment members, stop members or tabs 54*a* and 56*a* extending from frame member 50*a* (see also FIG. 9). Catch 190*a* cannot rotate in a counterclockwise direction because of abutment of shaft 70*a* with a second end of curved slot or opening 193*a*. As a result the contact of abutment section 195*a* with one of tabs 54*a* and 56*a* and the abutment of slot 193*a* with shaft 70*a*, the rotation of hub assembly 100*a* is brought to a halt.

As described in connection with self-retracting lifeline system 10, the biasing force exerted by catch spring 200*a* can be balanced against the rotational inertia of catch 190*a* so that catch 190*a* "actuates" only when lifeline web 40*a* is being pulled from self-retracting lanyard 10*a* at a predetermined accelerating rate corresponding, for example, to the beginning of a fall. For example, catch 190*a* and catch spring 200*a* can be readily designed (using engineering principles known to those skilled in the art) to actuate when lifeline web 40*a* is being pulled out at a certain determined acceleration (for example, ½ or ¾ times the acceleration of gravity). For lower accelerations or when the user is extending the web at a constant rate, such as when walking, catch 190*a* will not actuate and hub assembly 100*a* will turn freely.

Figure 14:
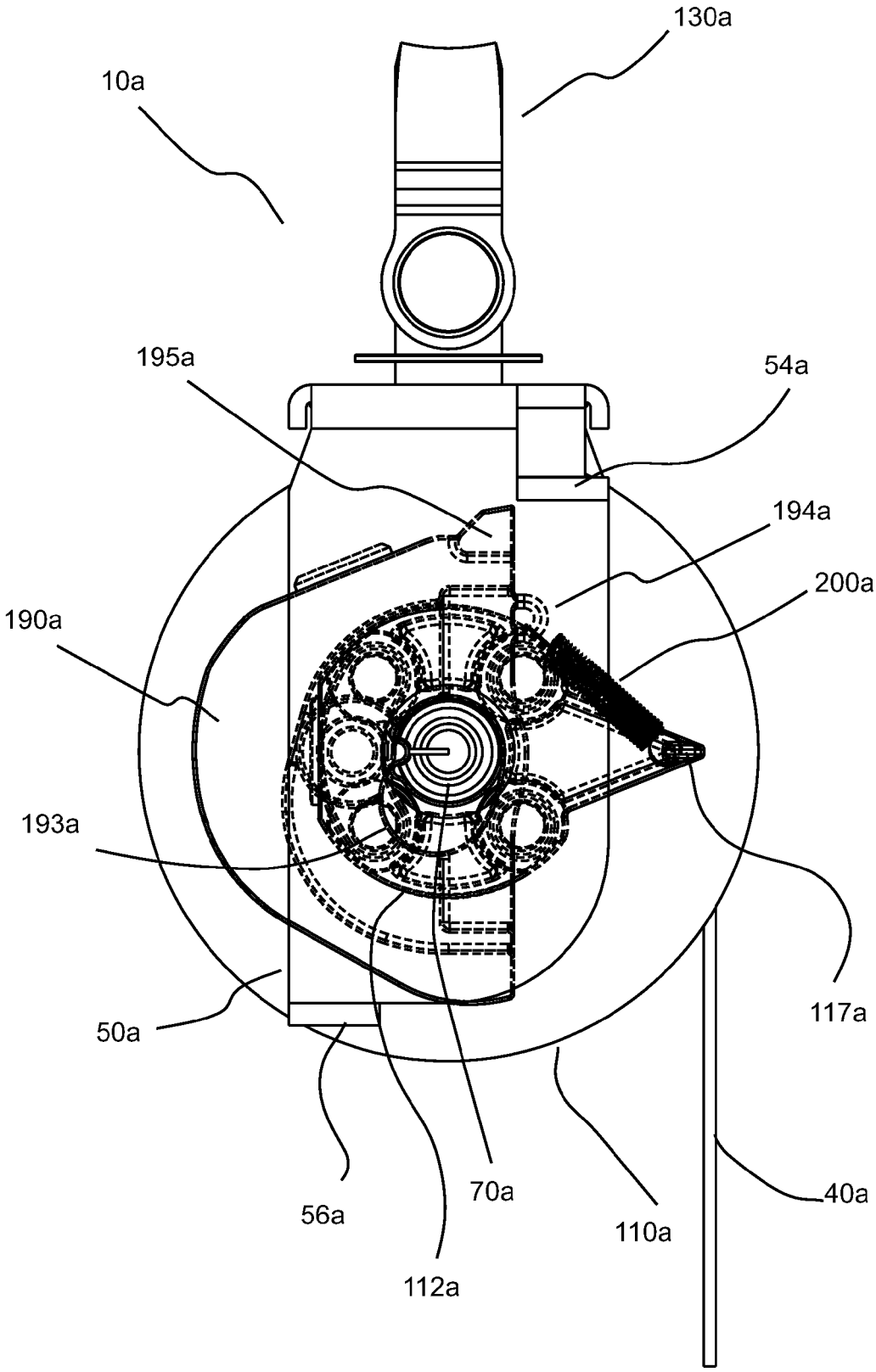
FIG. 14 illustrates the self-retracting lifeline system of FIG. 8 wherein a frame member is again illustrated to be partially transparent and wherein the tension on the lifeline has been relaxed from the state of FIG. 13 to allow the hub assembly to retract the lifeline a short distance and wherein the abutment section of the catch has moved away from (rotated out of) abutment with the abutment member of the frame member.

FIG. 14 illustrates self-retracting lifeline 10*a* wherein frame member 50*a* is again illustrated to be partially transparent. FIG. 14 illustrates a position of the components of self-retracting lifeline 10*a* in the case wherein, after being locked or braked as illustrated in FIG. 13, the user has relaxed the tension on lifeline web 40*a* to allow hub assembly 100*a* to retract lifeline web 40*a* a short distance. As hub assembly 100*a* rotates counterclockwise (as a result of the tensioning force of tensioning mechanism 160*a*), abutment section 195*a* of catch 190*a* moves away from abutment with the abutment member or tab 54*a*. Catch 190*a* then rotates (as a result of the biasing force of catch spring 200*a*) about the axis of pivot member 180*a* clockwise relative to hub assembly 100*a*. At this point, hub assembly 100*a* is now free to rotate again.

In the above embodiments, the catch base is a component of or is attached to the drum assembly. However, one skilled in the art appreciates that the catch base (that is, that element to which the catch is rotatably attached about an axis other than the axis of the main shaft) can be separate from or not connected to the drum assembly. In that regard, the catch base can be a separate element or connected to a component of the lifeline system other than the drum assembly. The catch base can, for example, be independently connected to or locked to the shaft so that the shaft and catch base rotate together. The catch, rotatably connected to the catch base (about an axis eccentric from the axis of the shaft), can operate as described above to stop rotation of the shaft and, thereby, stop rotation of a lifeline hub (which can be part of a drum assembly) connected to the shaft.

Although the present invention has been described herein in connection with the representative example of a lifeline formed of a web material, the systems, devices and methods of the present invention will operate equally well with a cable, a rope, or other type of lifeline coiled or spooled on a hub or drum assembly. Moreover, the acceleration-based braking systems of the present invention can be used in connection with systems other than self-retracting lanyards.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A lifeline system, comprising:

a lifeline;

a drum assembly around which the lifeline is coiled, the drum assembly being rotatable about a first axis in a first direction during extension of the lifeline and in a second direction, opposite of the first direction, during retraction of the lifeline;

a tensioning mechanism in operative connection with the drum assembly to impart a biasing force on the drum assembly to bias the drum assembly to rotate about the first axis in the second direction; and a braking mechanism carried on a hub plate of the drum assembly for rotation therewith, the braking mechanism comprising a catch that is rotatable about a second axis that is not concentric with the first axis, the second axis being operatively connected to the first axis so that the second axis rotates about the first axis in the same direction as the drum assembly when the drum assembly is rotating about the first axis, a center of mass of the catch being located in the vicinity of the second axis, the first axis extending through the catch, the catch rotating about the second axis in the second direction when the drum assembly is rotated in the first direction at least a determined angular acceleration to cause an abutment section of the catch to abut an abutment member of the lifeline system and stop the rotation of the drum assembly.

2. The system of claim 1 further comprising a biasing mechanism to bias the catch against rotating in the second direction.

3. The system of claim 2 wherein a biasing force of the biasing mechanism is balanced against rotational inertia of the catch so that catch rotates in the second direction only when the lifeline is extended at an accelerating rate corresponding to the determined angular acceleration of the drum assembly.

4. The system of claim 3 wherein the biasing mechanism comprising a torsion spring attached at one end to the drum assembly and attached at another end to the catch.

5. The system of claim 3 wherein the biasing mechanism comprising an extension spring, a compression spring or a spring clip attached at one end to the drum assembly and attached at another end to the catch.

6. The system of claim 3 wherein the first axis is defined by a shaft passing generally through the center of the drum assembly, the shaft also passing through a slot formed in the catch.

7. The system of claim 6 wherein the catch is rotatable about the second axis and relative to the drum assembly about an extending member extending from the drum assembly, the extending member defining the second axis.

8. The system of claim 6 wherein the system comprises at least one abutment element to limit rotation of the catch in the first direction and limit rotation of the catch in the second direction.

9. The system of claim 6 wherein the slot of the catch is curved and abutment of edges of the slot with the shaft limits rotation of the catch in the first direction and limits rotation of the catch in the second direction.

10. The system of claim 6 wherein a center of mass of the catch is located generally upon the second axis.

11. A braking mechanism for use in a lifeline system, comprising a lifeline, a drum assembly around which the lifeline is coiled, the drum assembly being rotatable about a shaft defining a first axis in a first direction during extension of the lifeline and in a second direction, opposite of the first direction, during retraction of the lifeline, and an abutment member; the braking mechanism comprising:

a catch comprising a slot through which the shaft can pass, an element defining a second axis about which the catch is rotatable that is spaced from the shaft and is not concentric with the first axis, the second axis being operatively connected to the shaft so that the second axis rotates about the first axis in the same direction as the drum assembly when the drum assembly is rotating about the first axis, a center of mass of the catch being located in the vicinity of the second axis, and at least one abutment section to abut the abutment member of the lifeline system and stop the rotation of the drum assembly upon rotation of the catch about the second axis in the second direction, wherein the catch rotates about the second axis in the second direction when the drum assembly is rotated in the first direction at least a determined angular acceleration.

12. The braking mechanism of claim 11 wherein a center of mass of the catch is located generally upon the second axis.

13. A lifeline system, comprising:

a lifeline;

a shaft having a first axis;

a hub connected to the shaft to rotate with the shaft, the lifeline being coiled around the hub, the hub being rotatable with the shaft in a first direction during extension of the lifeline and in a second direction, opposite of the first direction, during retraction of the lifeline;

an abutment member;

a tensioning mechanism in operative connection with shaft to impart a biasing force on the shaft to bias the shaft to rotate about the first axis in the second direction; and a braking mechanism in operative connection with the shaft, the braking mechanism comprising a catch that is rotatable about a second axis that is spaced from the shaft and is not concentric with the first axis, the second axis being operatively connected to the shaft so that the second axis rotates about the first axis in the same direction as the drum assembly when the drum assembly is rotating about the first axis, a center of mass of the catch being located in the vicinity of the second axis, the first axis extending through the catch, the catch rotating about the second axis in the second direction when the shaft is rotated in the first direction at least a determined angular acceleration to cause an abutment section of the catch to move radially outward relative to the shaft a sufficient amount to abut the abutment member of the lifeline system and stop the rotation of the shaft.

14. The braking mechanism of claim 13 wherein a center of mass of the catch is located generally upon the second axis.

15. A braking mechanism for use in a lifeline system, comprising a lifeline, a shaft having a first axis; a hub connected to the shaft to rotate with the shaft, the lifeline being coiled around the hub, the hub being rotatable with the shaft in a first direction during extension of the lifeline and in a second direction, opposite of the first direction, during retraction of the lifeline; and an abutment member; the braking mechanism comprising:

a catch comprising a slot through which the shaft can pass, an element having a second axis about which the catch is rotatable that is spaced from the shaft and is not concentric with a first axis defined by the shaft, the element being operatively connected to the shaft so that the element rotates about the first axis in the same direction as the hub when the hub is rotating about the first axis, a center of mass of the catch being located in the vicinity of the second axis of the element, and at least one abutment section in the vicinity of a perimeter of the catch, the catch rotating about the second axis in the second direction when the shaft is rotated in the first direction at least a determined angular acceleration to cause the abutment section of the catch to move radially outward relative to the shaft a sufficient amount to abut the abutment member of the lifeline system and stop the rotation of the shaft.

16. The braking mechanism of claim 15 wherein a center of mass of the catch is located generally upon the second axis.

17. A method of providing a braking function in a lifeline system comprising a lifeline, a drum assembly around which the lifeline is coiled, wherein the drum assembly is rotatable about a first axis in a first direction during extension of the lifeline and in a second direction, opposite of the first direction, during retraction of the lifeline, a tensioning mechanism in operative connection with the drum assembly to impart a biasing force on the drum assembly to bias the drum assembly to rotate about the first axis in the second direction, and an abutment member; comprising:

carrying a braking mechanism on a hub plate of the drum assembly, wherein the braking mechanism comprises a catch that is rotatable about a second axis that is not concentric with the first axis, the second axis being operatively connected to the first axis so that the second axis rotates about the first axis in the same direction as the drum assembly when the drum assembly is rotating about the first axis, a center of mass of the catch being located in the vicinity of the second axis, the first axis extending through the catch, the catch rotating about the second axis in the second direction when the drum assembly is rotated in the first direction at least a determined angular acceleration to cause an abutment section of the catch to move radially outward relative to the first axis a sufficient amount to abut the abutment member of the lifeline system and stop the rotation of the drum assembly.

18. The method of claim 17 further comprising biasing the catch against rotating in the second direction.

19. The method of claim 18 wherein a biasing force applied to the catch is balanced against rotational inertia of the catch so that catch rotates in the second direction only when the lifeline is extended at an accelerating rate corresponding to the determined angular acceleration of the drum assembly.

20. The method of claim 19 further comprising providing at least one abutment element to limit rotation of the catch in the first direction and limit rotation of the catch in the second direction.

* * * * *